US011826604B2

(12) United States Patent
Lagree et al.

(10) Patent No.: US 11,826,604 B2
(45) **Date of Patent: *Nov. 28, 2023**

(54) TILTING EXERCISE MACHINE

(71) Applicant: Lagree Technologies, Inc., Chatsworth, CA (US)

(72) Inventors: Sebastien Anthony Louis Lagree, Chatsworth, CA (US); John C. Hamilton, Santa Clarita, CA (US); Andy H. Gibbs, Oro Valley, AZ (US)

(73) Assignee: Lagree Technologies, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/901,242

(22) Filed: Sep. 1, 2022

(65) Prior Publication Data

US 2022/0409946 A1 Dec. 29, 2022

Related U.S. Application Data

(63) Continuation of application No. 17/194,738, filed on Mar. 8, 2021, now Pat. No. 11,433,271, which is a (Continued)

(51) Int. Cl.
*A63B 21/00* (2006.01)
*A63B 21/062* (2006.01)

(Continued)

(52) U.S. Cl.
CPC .... *A63B 21/4031* (2015.10); *A63B 21/00069* (2013.01); *A63B 21/023* (2013.01);

(Continued)

(58) Field of Classification Search
CPC ..... A63B 21/00047; A63B 21/00065; A63B 21/00069; A63B 21/0051; A63B 21/023;

(Continued)

(56) References Cited

U.S. PATENT DOCUMENTS 1,621,477 A 3/1927 Pilates
1,866,868 A 7/1932 Thomson (Continued)

FOREIGN PATENT DOCUMENTS

EP 0354785 A2 2/1990
KR 101226434 B1 1/2013

(Continued)

OTHER PUBLICATIONS http://www.walmart.com/ip/total-gym-1400/23816097?adid=15000000000000027727770; Webpage from www.Walmart.com for the Total Gym 1400; Printed.

PCT Preliminary Report on Patentability and Opinion for PCT/US2015/033463; dated Dec. 15, 2016.

PCT International Search Report for PCT/US2017/028393; dated Jul. 11, 2017.

www.SolidMasters.com; SolidMasters Website Page via Archive.org; Jul. 7, 2014.

(Continued)

*Primary Examiner* — Megan Anderson

(74) *Attorney, Agent, or Firm* — Neustel Law Offices

(57) ABSTRACT

The present invention relates to the field of fitness training devices and exercise machines. More specifically, a substantially horizontal exercise machine comprising an exercise platform slidable along one or more rails aligned with the longitudinal axis of the machine structure, the slidable platform spring-biased towards one end of the machine, is tiltable to allow for one end of the machine to be raised or lowered relative to the opposed end of the machine.

18 Claims, 18 Drawing Sheets

Related U.S. Application Data continuation of application No. 16/419,911, filed on May 22, 2019, now Pat. No. 10,940,358, which is a continuation of application No. 15/491,540, filed on Apr. 19, 2017, now Pat. No. 10,300,328.

(60) Provisional application No. 62/324,582, filed on Apr. 19, 2016.

(51) Int. Cl.

| | |
|---|---|
| ***A63B 21/055*** | (2006.01) |
| ***A63B 22/00*** | (2006.01) |
| ***A63B 21/068*** | (2006.01) |
| ***A63B 22/20*** | (2006.01) |
| ***A63B 24/00*** | (2006.01) |
| ***A63B 21/04*** | (2006.01) |
| ***A63B 21/02*** | (2006.01) |

(52) U.S. Cl.

CPC ..... *A63B 21/0407* (2013.01); *A63B 21/055* (2013.01); *A63B 21/068* (2013.01); *A63B 21/0622* (2015.10); *A63B 21/154* (2013.01); *A63B 21/4035* (2015.10); *A63B 22/0023* (2013.01); *A63B 22/0046* (2013.01); *A63B 22/0089* (2013.01); *A63B 21/00047* (2013.01); *A63B 21/00065* (2013.01); *A63B 21/4027* (2015.10); *A63B 21/4029* (2015.10); *A63B 21/4033* (2015.10); *A63B 21/4045* (2015.10); *A63B 22/001* (2013.01); *A63B 22/0007* (2013.01); *A63B 22/0087* (2013.01); *A63B 22/203* (2013.01); *A63B 22/205* (2013.01); *A63B 24/0087* (2013.01); *A63B 2208/12* (2013.01); *A63B 2225/09* (2013.01); *A63B 2225/093* (2013.01); *A63B 2225/50* (2013.01)

(58) Field of Classification Search

CPC ..... A63B 21/0407; A63B 21/055; A63B 21/0552; A63B 21/0609; A63B 21/0622; A63B 21/068; A63B 21/154; A63B 21/4027; A63B 21/4029; A63B 21/4031; A63B 21/4033; A63B 21/4035; A63B 21/4045; A63B 22/0007; A63B 22/001; A63B 22/0046; A63B 22/0087; A63B 22/0089; A63B 22/203; A63B 22/205; A63B 24/0087; A63B 2208/12; A63B 2225/09; A63B 2225/093; A63B 2225/50

See application file for complete search history.

(56) References Cited

U.S. PATENT DOCUMENTS

| | | | | |
|---|---|---|---|---|
| 3,770,267 | A | 11/1973 | McCarthy | |
| 4,240,627 | A | 12/1980 | Brentham | |
| 4,759,540 | A | 7/1988 | Yu | |
| 4,798,378 | A | 1/1989 | Jones | |
| 5,066,005 | A | 11/1991 | Luecke | |
| 5,141,480 | A | 8/1992 | Lennox | |
| 5,263,913 | A | 11/1993 | Boren | |
| D362,700 | S | 9/1995 | Breibart | |
| 5,460,596 | A | 10/1995 | Brady | |
| D382,319 | S | 8/1997 | Gerschefske | |
| 5,681,249 | A | 10/1997 | Endelman | |
| 5,782,639 | A | 7/1998 | Beal | |
| 5,820,478 | A * | 10/1998 | Wood | A63B 69/3652 473/279 |
| 5,885,197 | A | 3/1999 | Barton | |
| 5,895,340 | A | 4/1999 | Keller | |
| 5,967,955 | A | 10/1999 | Westfall | |
| 6,179,753 | B1 | 1/2001 | Barker | |
| 6,243,897 | B1 | 6/2001 | Sumiya | |
| 6,761,667 | B1 | 7/2004 | Cutler | |
| 6,796,927 | B2 | 9/2004 | Toyama | |
| 6,851,144 | B2 | 2/2005 | Wang | |
| 7,163,500 | B2 | 1/2007 | Endelman | |
| 7,270,628 | B2 | 9/2007 | Campanaro | |
| 7,530,929 | B2 | 5/2009 | Feldman | |
| 7,803,095 | B1 | 9/2010 | Lagree | |
| 7,931,570 | B2 | 4/2011 | Hoffman | |
| 7,935,032 | B1 | 5/2011 | Jackson | |
| 7,998,043 | B2 | 8/2011 | Zhou | |
| 8,012,073 | B2 | 9/2011 | Barnett | |
| 8,192,332 | B2 | 6/2012 | Baker | |
| 8,249,714 | B1 | 8/2012 | Hartman | |
| 8,356,996 | B2 | 1/2013 | Mayrhofer | |
| 8,585,554 | B2 | 11/2013 | Shavit | |
| 8,641,585 | B2 | 2/2014 | Lagree | |
| 8,721,506 | B2 | 5/2014 | Gerschefske | |
| 8,734,307 | B2 | 5/2014 | Bathey | |
| 8,764,609 | B1 | 7/2014 | Elahmadie | |
| 8,858,409 | B2 | 10/2014 | Trees | |
| 8,870,726 | B2 | 10/2014 | Watterson | |
| 9,022,909 | B2 | 5/2015 | Kermath | |
| 9,038,218 | B1 | 5/2015 | Heil | |
| 9,050,517 | B2 | 6/2015 | Oliver | |
| 9,125,785 | B2 | 9/2015 | Trees | |
| 9,132,051 | B2 | 9/2015 | Heil | |
| 9,339,712 | B2 | 5/2016 | De Biasi | |
| 9,539,462 | B2 | 1/2017 | Carter | |
| 9,545,535 | B2 * | 1/2017 | Lagree | A63B 22/0664 |
| 10,046,193 | B1 | 8/2018 | Aronson | |
| 10,499,730 | B2 | 12/2019 | Kim | |
| 2001/0056011 | A1 | 12/2001 | Endelman | |
| 2002/0022551 | A1 | 2/2002 | Watterson | |
| 2003/0078138 | A1 | 4/2003 | Toyama | |
| 2003/0119635 | A1 | 6/2003 | Arbuckle | |
| 2004/0077464 | A1 | 4/2004 | Feldman | |
| 2004/0142800 | A1 | 7/2004 | Gerschefske | |
| 2004/0248710 | A1 | 12/2004 | Rodgers, Jr. | |
| 2005/0130810 | A1 | 6/2005 | Sands | |
| 2005/0164856 | A1 | 7/2005 | Parmater | |
| 2006/0046914 | A1 | 3/2006 | Endelman | |
| 2006/0172862 | A1 | 8/2006 | Badarneh | |
| 2006/0199712 | A1 | 9/2006 | Barnard | |
| 2006/0211543 | A1 | 9/2006 | Feldman | |
| 2006/0293156 | A1 | 12/2006 | Trees | |
| 2007/0087921 | A1 | 4/2007 | Graham | |
| 2008/0070765 | A1 | 3/2008 | Brown | |
| 2008/0242511 | A1 | 10/2008 | Munoz | |
| 2008/0248935 | A1 | 10/2008 | Solow | |
| 2009/0023556 | A1 | 1/2009 | Daly | |
| 2009/0156372 | A1 | 6/2009 | Solomon | |
| 2009/0203505 | A1 | 8/2009 | Kroll | |
| 2009/0209393 | A1 | 8/2009 | Crater | |
| 2010/0056289 | A1 | 3/2010 | Zhou | |
| 2010/0227748 | A1 | 9/2010 | Campanaro | |
| 2011/0009249 | A1 | 1/2011 | Campanaro | |
| 2011/0039669 | A1 | 2/2011 | Stewart | |
| 2011/0082016 | A1 | 4/2011 | Kim | |
| 2011/0143898 | A1 | 6/2011 | Trees | |
| 2011/0152032 | A1 | 6/2011 | Barnett | |
| 2011/0166002 | A1 | 7/2011 | Savsek | |
| 2011/0172069 | A1 | 7/2011 | Gerschefske | |
| 2012/0071301 | A1 | 3/2012 | Kaylor | |
| 2012/0088634 | A1 | 4/2012 | Heidecke | |
| 2012/0122637 | A1 | 5/2012 | Bathey | |
| 2012/0295771 | A1 | 11/2012 | Lagree | |
| 2013/0008452 | A1 | 1/2013 | Evangelos | |
| 2013/0017935 | A1 | 1/2013 | Endelman | |
| 2013/0150219 | A1 | 6/2013 | Chang | |
| 2013/0196835 | A1 | 8/2013 | Solow | |
| 2014/0011645 | A1 | 1/2014 | Johnson | |
| 2014/0100089 | A1 | 4/2014 | Kermath | |
| 2014/0121076 | A1 | 5/2014 | Lagree | |
| 2014/0121078 | A1 | 5/2014 | Lagree | |
| 2014/0121079 | A1 | 5/2014 | Lagree | |
| 2014/0141948 | A1 | 5/2014 | Aronson | |
| 2015/0011362 | A1 | 1/2015 | Oh | |
| 2015/0024914 | A1 | 1/2015 | Lagree | |
| 2015/0057127 | A1 | 2/2015 | Lagree | |

(56) References Cited

U.S. PATENT DOCUMENTS

| | | | | |
|---|---|---|---|---|
| 2015/0065318 | A1 | 3/2015 | Lagree | |
| 2015/0072841 | A1 | 3/2015 | Lagree | |
| 2015/0141204 | A1 | 5/2015 | Lagree | |
| 2015/0217164 | A1 | 8/2015 | Lagree | |
| 2015/0220523 | A1 | 8/2015 | Lagree | |
| 2015/0246263 | A1 | 9/2015 | Campanaro | |
| 2015/0297944 | A1 | 10/2015 | Lagree | |
| 2015/0343250 | A1 | 12/2015 | Lagree | |
| 2015/0360068 | A1 | 12/2015 | Lagree | |
| 2015/0360083 | A1 | 12/2015 | Lagree | |
| 2015/0360113 | A1 | 12/2015 | Lagree | |
| 2015/0364058 | A1 | 12/2015 | Lagree | |
| 2015/0367166 | A1 | 12/2015 | Lagree | |
| 2016/0008657 | A1 | 1/2016 | Lagree | |
| 2016/0166870 | A1 | 6/2016 | Lagree | |
| 2018/0178053 | A1* | 6/2018 | Lagree | A63B 21/00069 |
| 2020/0222741 | A1 | 7/2020 | Aronson | |

FOREIGN PATENT DOCUMENTS

| | | | |
|---|---|---|---|
| WO | 2004096376 | A1 | 11/2004 |
| WO | 2008010797 | A1 | 1/2008 |

OTHER PUBLICATIONS www.SolidMasters.com, Picture from SolidMasters Website Page via Archive.org; Jul. 7, 2014.

EPO Search Report for Application No. EP15807353.6; dated Feb. 9, 2018.

https://www.youtube.com/watch?v=froSxJ3T6jE; Screen capture at 1:52 in the YouTube video titled "Megaformer Evolution Promo"; Sep. 1, 2014.

PCT Preliminary Report on Patentability and Opinion for PCT/US2017/028393; dated Nov. 1, 2018.

PCT International Search Report for PCT/US2015/033463; dated Sep. 1, 2015.

* cited by examiner

TILTING EXERCISE MACHINE

CROSS REFERENCE TO RELATED APPLICATIONS

The present application is a continuation of U.S. application Ser. No. 17/194,738 filed on Mar. 8, 2021 which issues as U.S. Pat. No. 11,433,271 on Sep. 6, 2022, which is a continuation of U.S. application Ser. No. 16/419,911 filed on May 22, 2019 now issued as U.S. Pat. No. 10,940,358, which is a continuation of U.S. application Ser. No. 15/491,540 filed on Apr. 19, 2017 now issued as U.S. Pat. No. 10,300,328 on May 28, 2019, which claims priority to U.S. Provisional Application No. 62/324,582 filed Apr. 19, 2016. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

The present invention relates to the field of fitness training devices and exercise machines. More specifically, a substantially horizontal exercise machine comprising an exercise platform slidable along one or more rails aligned with the longitudinal axis of the machine structure, the slidable platform spring-biased towards one end of the machine, is tiltable to allow for one end of the machine to be raised or lowered relative to the opposed end of the machine.

Related Art

Any discussion of the related art throughout the specification should in no way be considered as an admission that such related art is widely known or forms part of common general knowledge in the field.

The exercise field is well known. Those skilled in the art will appreciate that traditional exercise machines with a sliding, substantially horizontal exercise platform, such as a Pilates machine, are intended to provide a stable surface upon which to exercise. However, fitness trainers understand that if the angle of exercise increases or decreases relative to the horizontal plane, the energy output of the exerciser correspondingly increases or decreases with the changes in the angular plane of the exercise machine. Nevertheless, the fixed horizontal exercise plane of traditional Pilates exercise machines have remained unchanged since their commercial introduction nearly 100 years ago. The benefits of tilting such an exercise machine, including the ability to increase or decrease the intensity of the exercise and the ability of an exerciser to engage muscles during a workout that would not otherwise have been engaged on a horizontal platform, would be recognized by those skilled in the art as a novel improvement, and well appreciated by the fitness industry.

SUMMARY

An exemplary embodiment of a tilting exercise machine generally includes exercise platforms located near its first and second ends and a slidable exercise platform in between, a base frame, a boom or stanchion structure pivotably mounted to the base frame and providing support for the exercise machine, and one or more actuators operable to cause the boom or stanchion structure to rotate about the pivotable mount and impart vertical movement to the first and second ends of the exercise machine to elevate and incline the exercise machine relative to a horizontal plane.

Some exemplary embodiments include a plurality of pivotable booms or stanchions arranged in an articulating parallelogram support structure providing for the inclination or declination of the exercise plane relative to the horizontal plane.

Therefore, one exemplary embodiment broadly comprises an exercise machine with a support structure providing for the inclination or declination of the supported exercise machine relative to a horizontal plane.

Another exemplary embodiment comprises an exercise machine supported by two opposed pairs of parallel booms, each pair of booms operable by means of an actuator, and the actuators being operable together or independently as a means to increase or decrease the angle of the plane of the upper surface of the exercise platforms relative to the horizontal plane.

Yet another exemplary embodiment comprises an exercise machine supported by two opposed pairs of pivotable stanchions, each stanchion of each parallel pair connected to the opposed stanchion of the opposed pair of pivotable stanchions by means of a linkage, and one actuator that pushes or pulls against one transverse power transfer bar to the pivotable stanchions and linkage as a means to increase or decrease the angle of the plane of the upper surface of the exercise platforms relative to the horizontal plane.

These and other embodiments will become known to one skilled in the art, especially after understanding the significant advantages of tilting an exercise apparatus as a means or engaging more muscles during a workout, and as a means to increase or decrease resistance level independent of a spring biasing means. The present invention is not intended to be limited to the disclosed embodiments.

There has thus been outlined, rather broadly, some of the embodiments of the tilting exercise machine in order that the detailed description thereof may be better understood, and in order that the present contribution to the art may be better appreciated. There are additional embodiments of the tilting exercise machine that will be described hereinafter and that will form the subject matter of the claims appended hereto. In this respect, before explaining at least one embodiment of the tilting exercise machine in detail, it is to be understood that the tilting exercise machine is not limited in its application to the details of construction or to the arrangements of the components set forth in the following description or illustrated in the drawings. The tilting exercise machine is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

Non-limiting and non-exhaustive embodiments are described with reference to the following figures, wherein like reference numerals refer to like parts throughout the various views unless otherwise specified.

DETAILED DESCRIPTION

A. Overview

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments" is not exhaustive and does not require that all embodiments include the discussed feature, advantage or mode of operation.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

An example tilting exercise machine generally comprises an upper structure comprising an elongated exercise machine and a lower support structure, which supports the exercise machine and provides elevation and inclination adjustments. The exercise machine generally has a common exercise plane, a first end and a second end with fixed exercise platforms, and a slidable exercise platform in between. The lower support structure generally comprises a base in the form of a frame, a plurality of parallel and opposed booms or stanchions pivotably mounted to the base and supporting the exercise machine, and one or more actuators. The actuator or actuators are operable to impart rotational movement to the booms or stanchions about their pivotable connections, and the booms or stanchions are arranged so as to translate such rotational movement into vertical movement of the first and second ends of the exercise machine, thus providing selective adjustment of the elevation and inclination of the exercise machine relative to a horizontal plane. Further details are provided below with reference to the figures.

Figure 1:
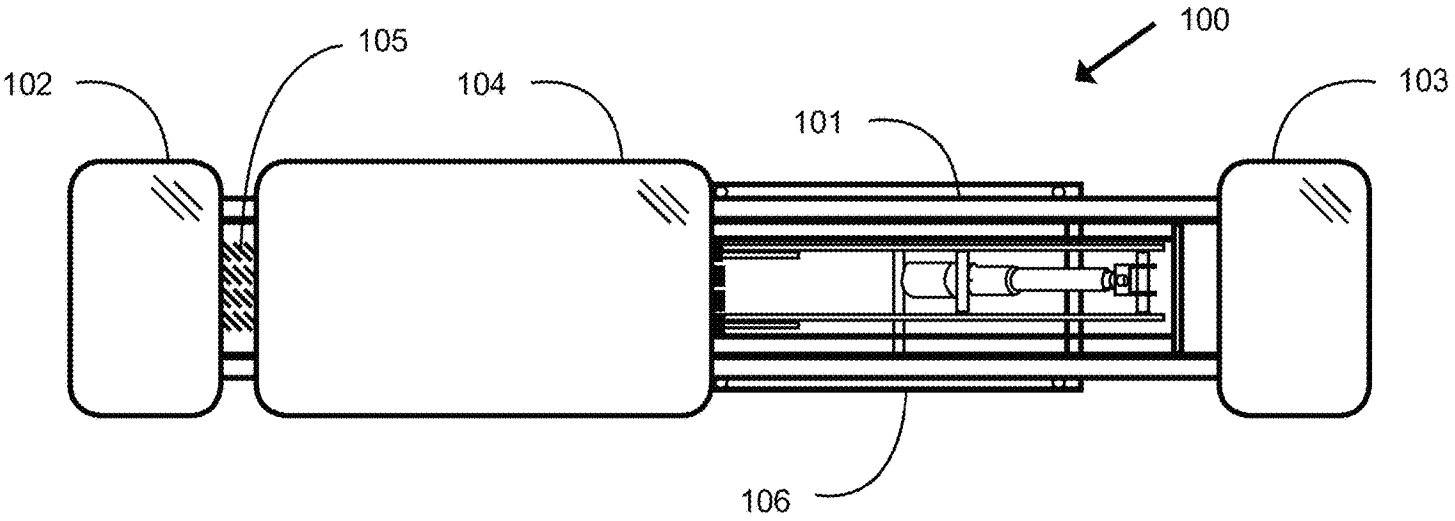
FIG. 1 is an exemplary diagram showing a top view of an exemplary embodiment of an exercise machine and support structure.

FIG. 1 is an exemplary diagram showing a top view of an exemplary embodiment of an exercise machine and support structure. An exercise machine 100 includes an upper frame structure comprising a substantially horizontal exercise platform 102 at a first end, a substantially horizontal exercise platform 103 at a second end, a substantially horizontal exercise platform 104, the platform slidable upon one or more tracks 101 extending substantially the length of the structure between the first and second platforms and parallel to the longitudinal axis of the machine, and a lower support structure 106. One or more biasing members 105 are connected between a first end and the slidable platform 104 to create a resistance force against which a user would exercise.

It should be noted that a biasing member, also referred to herein as a "biasing means," is not meant to be limiting, and may comprise one or more of at least an extension spring, elastic band, spring biased pulley, eddy current brake, or through-pulley weighted rope or cable as functionally equivalent without any difference in meaning.

Figure 2:
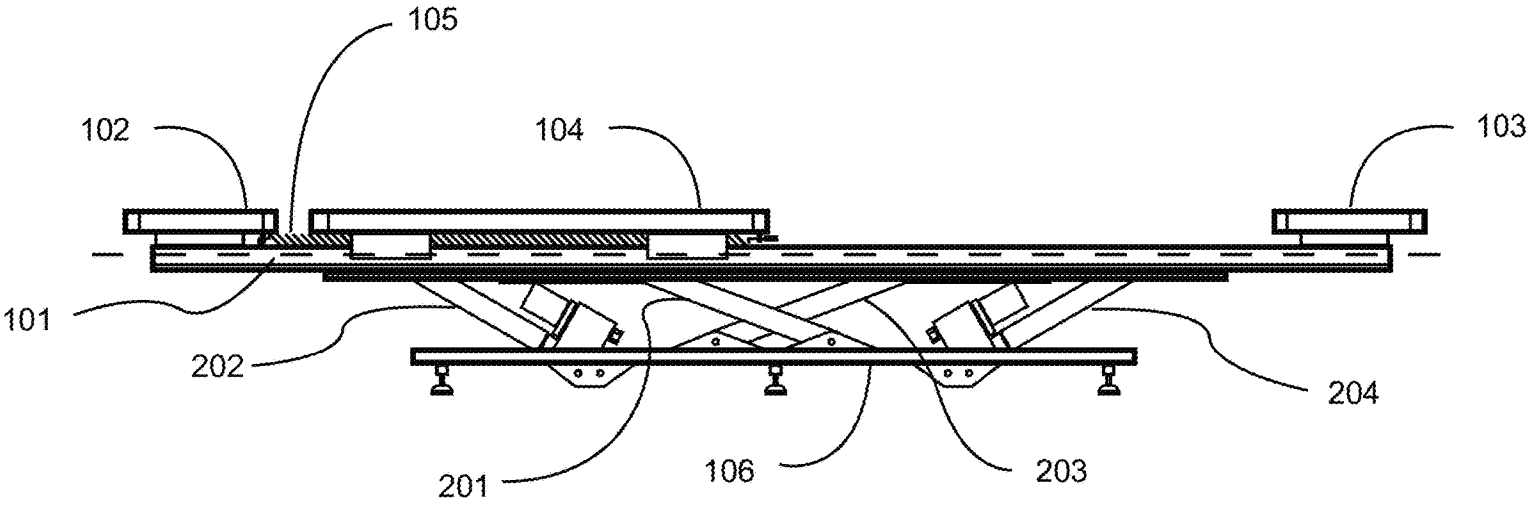
FIG. 2 is an exemplary diagram showing a side view of an exercise machine and support structure.

FIG. 2 is an exemplary diagram showing a side view of the exercise machine and support structure of FIG. 1. An exercise machine comprising a first end platform 102, a second end platform 103, a platform 104 slidable upon one or more tracks 101 there between and a biasing means 105 is supported by a support structure.

The base support structure 106 comprises a base frame and a plurality of feet, and connected thereto a first parallel pair of booms 201 providing for platform stability against unwanted rotation about the longitudinal axis of the machine while lifting of the first end relative to the second end, and a luffing actuator 202 providing the lifting of the first end. Further provided is a second parallel pair of booms 203 providing for platform stability against unwanted rotation about the longitudinal axis of the machine while lifting of the second end relative to the first end, and a luffing actuator 204 providing the lifting of the second end.

Figure 3:
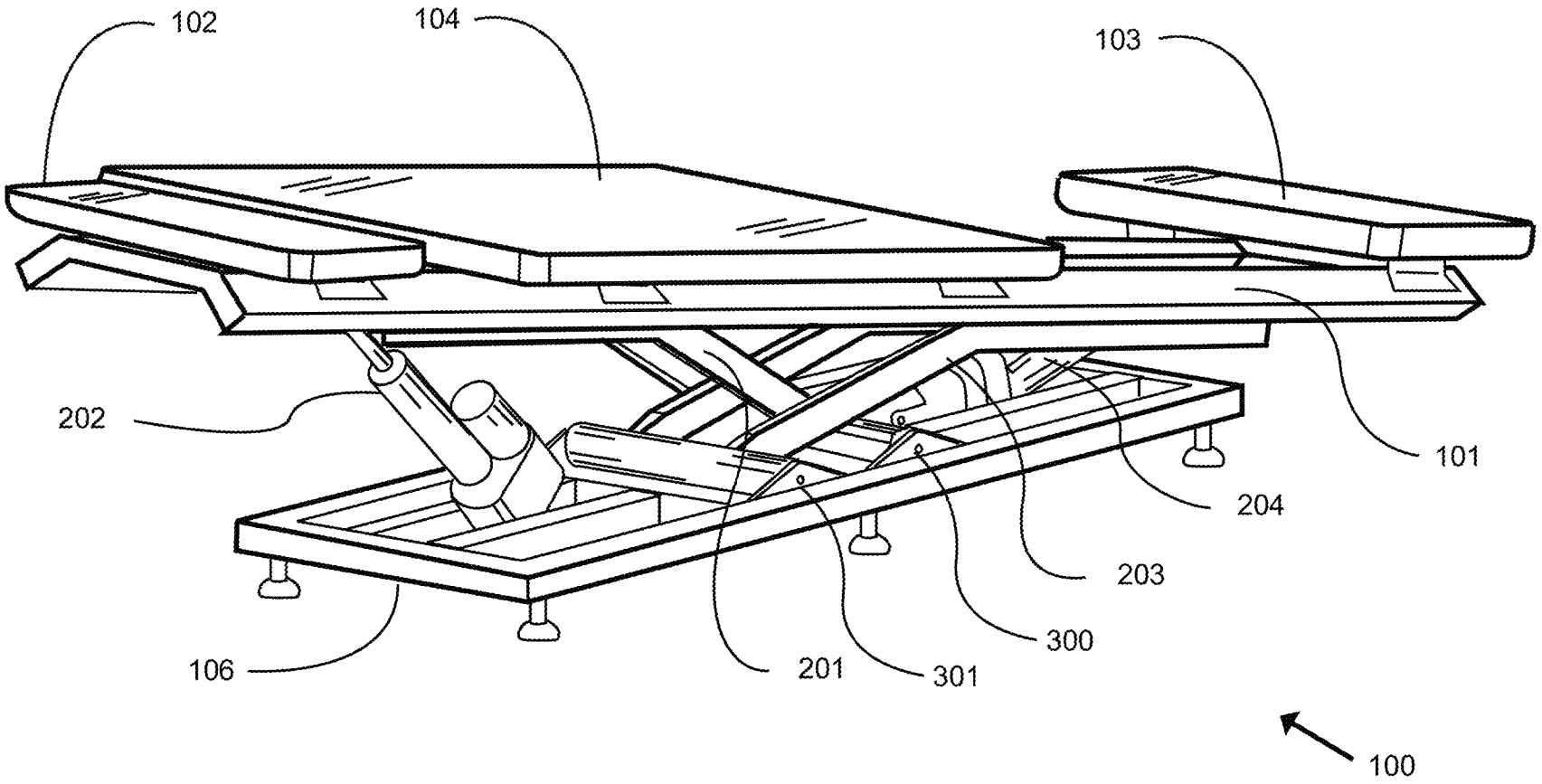
FIG. 3 is an exemplary diagram showing a perspective view of an exercise machine and support structure.

FIG. 3 is an exemplary diagram showing a perspective view of the exercise machine and support structure 100 of FIG. 1. An exercise machine comprises one or more tracks 101, a horizontal platform 102 substantially parallel to the tracks and securedly attached at a first end, a horizontal platform 103 substantially parallel to the tracks and securedly attached at a second end, a movable platform 104 slidably engaging with the tracks, and a biasing means 105 (not shown) connected between the movable platform and the first end. The machine just described is supported by the support structure comprising a frame 106 and a plurality of luffing actuators 202, 204, and two opposed pairs of parallel booms 201, 203 pivotably connected to the support structure by a plurality of pivot points represented by transverse hinge pins 300, 301. The parallel booms provide rotational rigidity to the exercise machine while the booms are being dynamically repositioned, as well as when the booms are static in a preferred position for exercising.

Figure 4:
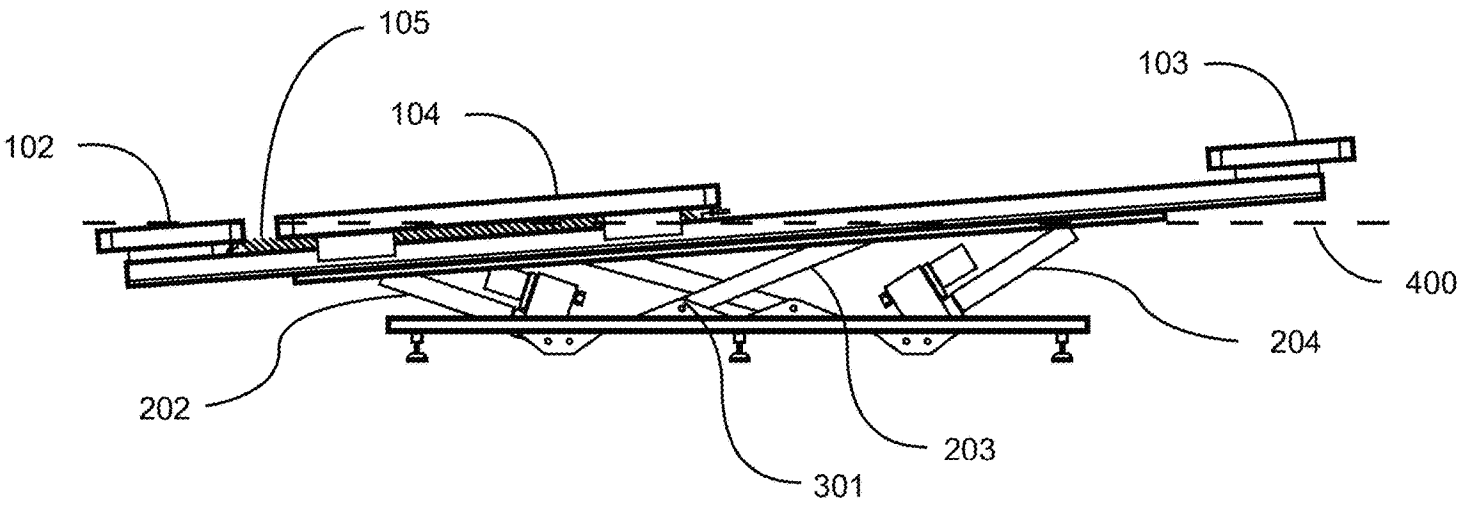
FIG. 4 is an exemplary diagram showing a side view of an exercise machine and support structure with a second end inclined.

FIG. 4 is an exemplary diagram showing a side view of the exercise machine and support structure of FIG. 1 with a second end inclined. An exercise machine as previously described is shown with a first end 102 positioned at a lower elevation relative to the second end 103. The second end of the exercise machine is therefore tilted upward at an acute angle relative to the horizontal plane 400 of the default elevation. By extending the second luffing actuator 204, the second pair of booms 203 are pivoted counterclockwise about the second pivot point 301, thereby allowing the upper surface of the second end of an exercise machine to pivot upwardly relative to the first end of the machine.

It is not the intention of the present invention to limit the type of actuator used to pivot the booms, nor to limit the operation of the actuator to any single means. Therefore, the word "luffing actuator" as used herein is meant to describe a device with an intended purpose of independently or simultaneously repositioning one or more pairs of substantially parallel pivotable booms relative to the support structure as a means of increasing or decreasing the vertical distance from the floor to a first end and second end of a substantially rectangular exercise machine. For the purposes just described, actuators may be linear or non-linear actuators, and operable by hydraulic, pneumatic, electric or mechanical means. Any actuator and method of operating the actuator may be used to pivot the booms thereby raising or lowering the first and/or second distal ends of the exercise machine. Further, actuators may be wire connected, or wirelessly connected to a controller unit.

Figure 5:
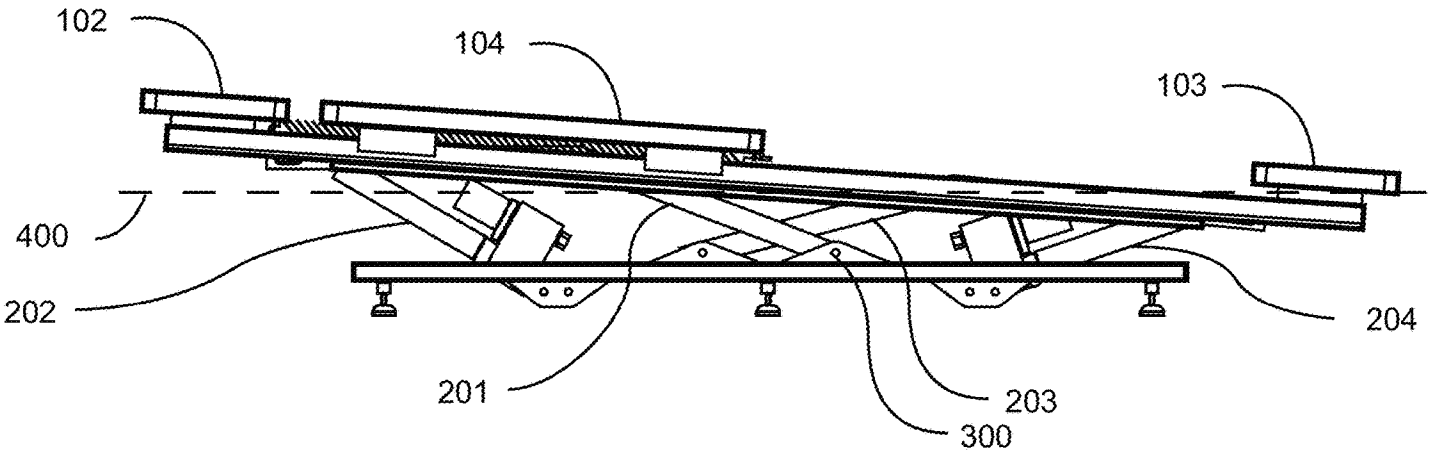
FIG. 5 is an exemplary diagram showing a side view of an exercise machine and support structure with a first end inclined.

FIG. 5 is an exemplary diagram showing a side view of the exercise machine and support structure of FIG. 1 with a first end inclined. An exercise machine as previously described is shown with a first end 102 positioned at a higher elevation relative to the second end 103. The first end of the exercise machine is therefore tilted upward at an acute angle relative to the horizontal plane 400 of the default elevation. By extending the luffing actuator 202, the booms 201 are pivoted upwardly by rotating clockwise about the first pivot point 300, thereby allowing the upper surface of the first end of the exercise machine to pitch at an upward angle relative to the horizontal plane.

Figure 6:
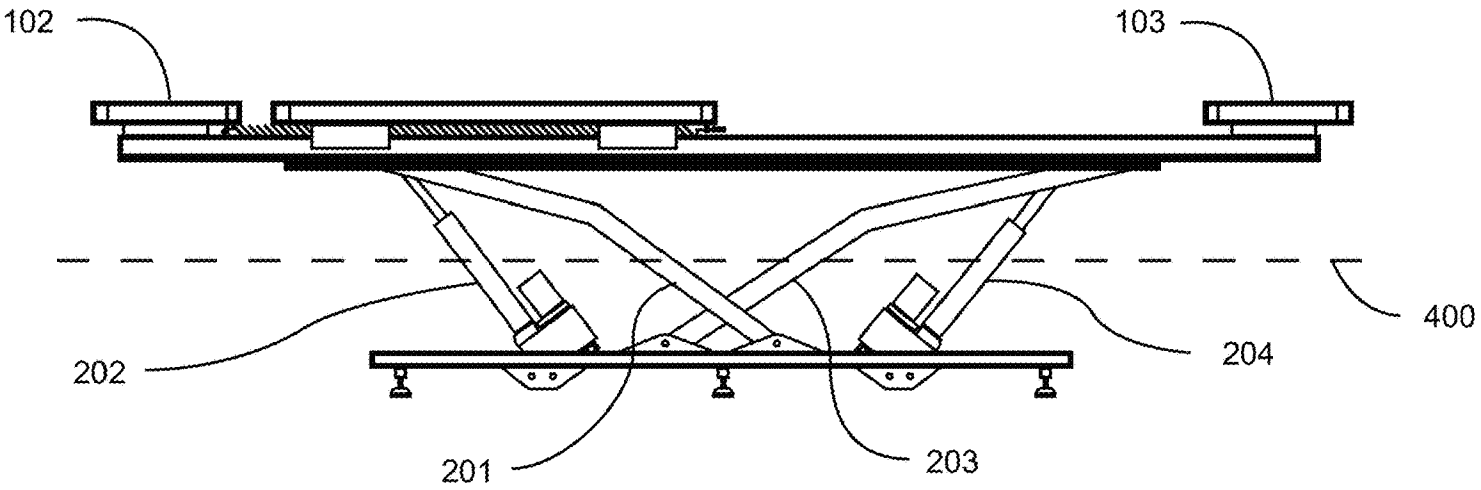
FIG. 6 is an exemplary diagram showing a side view of an exercise machine and support structure with the horizontal exercise plane elevated.

FIG. 6 is an exemplary diagram showing a side view of the exercise machine and support structure of FIG. 1 with the horizontal exercise plane elevated. More specifically, the present invention provides for increasing the height of the exercise platform if preferred for the performance of certain exercises. As can be seen, the platform of the first end 102 and the platform of the second end 103 are substantially aligned on a horizontal plane that is elevated from the plane 400 of the default elevation. This is accomplished by simultaneously or sequentially extending the luffing actuators 202, 204, thereby raising the distal ends of the booms 201, 203, which cradle the structure of the exercise machine.

Figure 7:
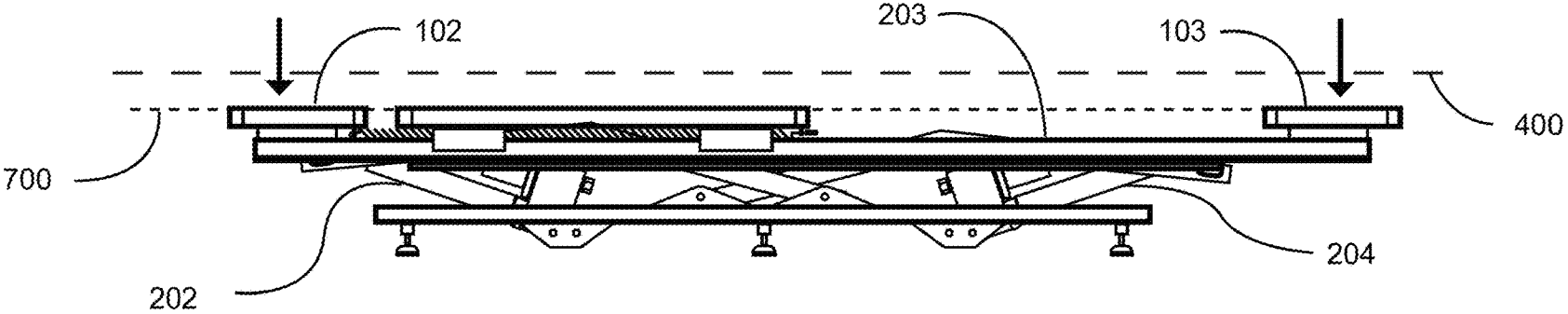
FIG. 7 is an exemplary diagram showing a side view of an exercise machine and support structure with the horizontal exercise plane lowered.

FIG. 7 is an exemplary diagram showing a side view of the exercise machine and support structure of FIG. 1 with the horizontal exercise plane lowered to an elevation 700 below the default elevation 400. The present invention therefore provides for decreasing the height of the exercise platform if preferred for ease of use by exercisers of smaller stature, or for the performance of certain exercises. The platform of the first end 102 and the platform of the second end 103 are substantially aligned on a horizontal plane 700 at its lowest horizontal elevation position. This is accomplished by simultaneously or sequentially activating the luffing actuators 202, 204, thereby lowering the distal ends of the booms 201, 203, which cradle the structure of the exercise machine.

Figure 8:
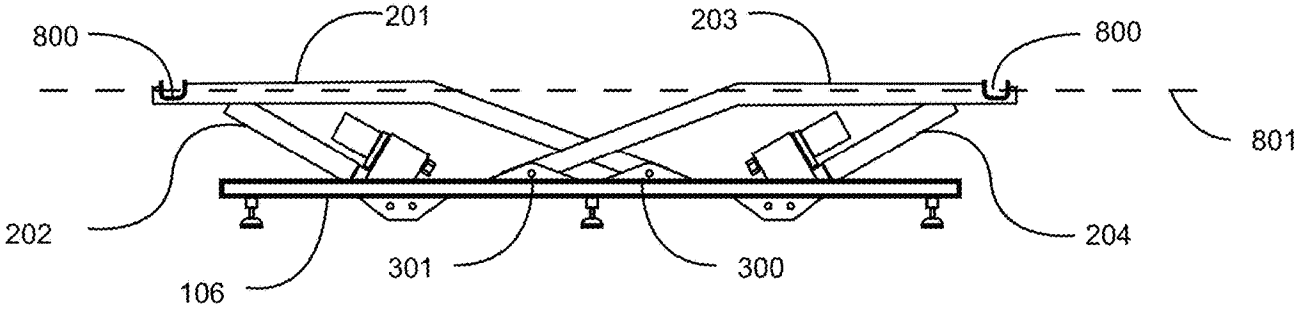
FIG. 8 is an exemplary diagram showing a side view of an exercise machine support structure with both pairs of booms moderately raised.

FIG. 8 is an exemplary diagram showing a side view of the exercise machine support structure of FIG. 1, the support structure comprising a frame 106, a first pair of parallel booms 201 pivotably connected at the proximate ends to the frame 300, a first luffing actuator 202 pivotably connected to a yoke 1302 (shown in FIG. 13) extending between the two parallel booms, the central axis of the yoke being aligned substantially transverse to the longitudinal axis of the machine, each boom comprising a cradle 800 at the distal ends into which a lifting member of the exercise machine (not shown) is positioned. Further, a second pair of parallel booms 203 are shown pivotably connected at the proximate ends to the frame 301, a second luffing actuator 204 pivotably connected to a yoke 1303 (shown in FIG. 13) extending between the two parallel booms, the central axis of the yoke being aligned substantially transverse to the longitudinal axis of the machine, each boom comprising a cradle 800 at the distal ends into which a second structural cross member of the exercise machine (not shown) is positioned.

For purposes of simplicity and clarity of discussion of the unique functionality of the present invention as will be described in FIGS. 9, 10 11, and 12, the horizontal plane 801 just described is referred to as the default elevation of the bearing surfaces of the cradles 800.

Figure 9:
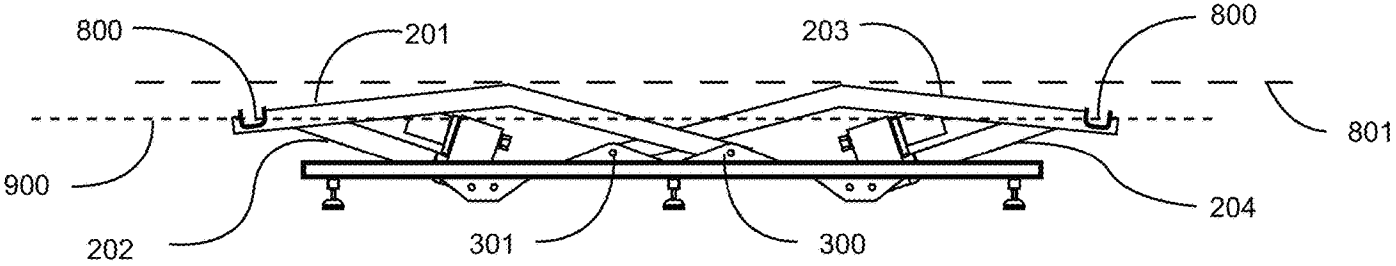
FIG. 9 is an exemplary diagram showing a side view of an exercise machine support structure with both pairs of booms lowered.

FIG. 9 is an exemplary diagram showing a side view of the exercise machine support structure of FIG. 1 with both pairs of booms lowered. It is sometimes preferred to position the exercise machine closer to the floor, for instance, when exercisers of smaller stature, such as children, or rehabilitation patients require a smaller step up to mount the exercise machine.

Now then, the default elevation 800 being shown by the referenced dotted line, the drawing shows that the first luffing actuator 202 is in a state of having been retracted, thereby having pivoted the first pair of booms 201 counterclockwise about the first pivot point 300 so that the cradles 800 are positioned on a plane at a lower elevation 900 when compared to the default elevation 800. Similarly, the second luffing actuator 204 is in a state of having been equally retracted, thereby having pivoted the second pair of booms 203 clockwise about the second pivot point 301 such that the cradles 800 are positioned on a substantially horizontal plane at a lower elevation 900 relative to the default elevation 801. The drawing therefore illustrates an exercise machine support structure positioned to support an exercise machine (not shown) on a substantially horizontal plane closer to the floor than the default elevation.

Figure 10:
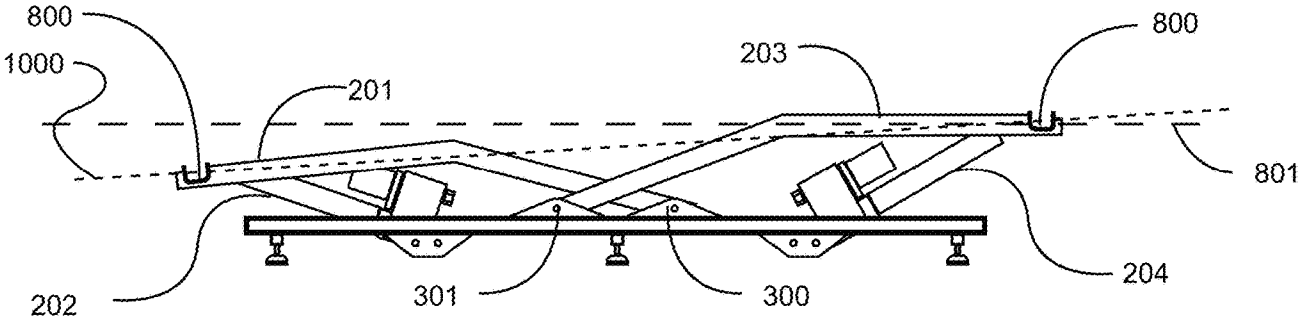
FIG. 10 is an exemplary diagram showing a side view of an exercise machine support structure with the second pair of booms elevated relative to the first pair of booms.

FIG. 10 is an exemplary diagram showing a side view of the exercise machine support structure of FIG. 1 with the second pair of booms 203 elevated relative to the position of the first pair of booms 201. In the drawing, the first pair of booms 201 of the support structure are positioned by activating the first luffing actuator 202 to rotate the booms about the first pivot point 300 until the cradles 800 at the distal ends of the booms are positioned at the desired elevation. By actuating the second luffing actuator 204, the second pair of booms 203 rotate about the second pivot point 301 until the cradles 800 at the distal ends of the booms are positioned at the desired elevation. The resulting configuration of the support structure is therefore intended to position the exercise plane of the exercise machine (not shown) with the second end of the machine pitched at an upward acute angle relative to the horizontal plane.

Figure 11:
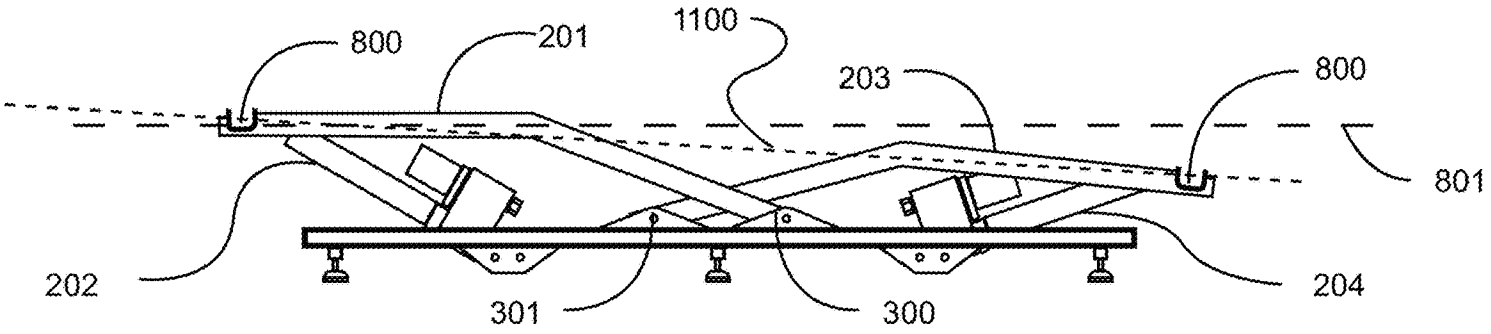
FIG. 11 is an exemplary diagram showing a side view of an exercise machine support structure with the first pair of booms elevated relative to the second pair of booms.

FIG. 11 is an exemplary diagram showing a side view of the exercise machine support structure of FIG. 1 with the second pair of booms 203 lowered relative to the position of the first pair of booms 201. In the drawing, the first pair of booms 201 of the support structure are positioned by activating the first luffing actuator 202 to rotate the booms about the first pivot point 300 until the cradles 800 at the distal ends of the booms are positioned at the desired elevation. By actuating the second luffing actuator 204, the second pair of booms 203 rotate about the second pivot point 301 until the cradles 800 at the distal ends of the booms are positioned at the desired elevation. The resulting configuration of the support structure is therefore intended to position the exercise plane of the exercise machine (not shown) with the second end of the machine pitched at a downward acute angle relative to the horizontal plane.

Figure 12:
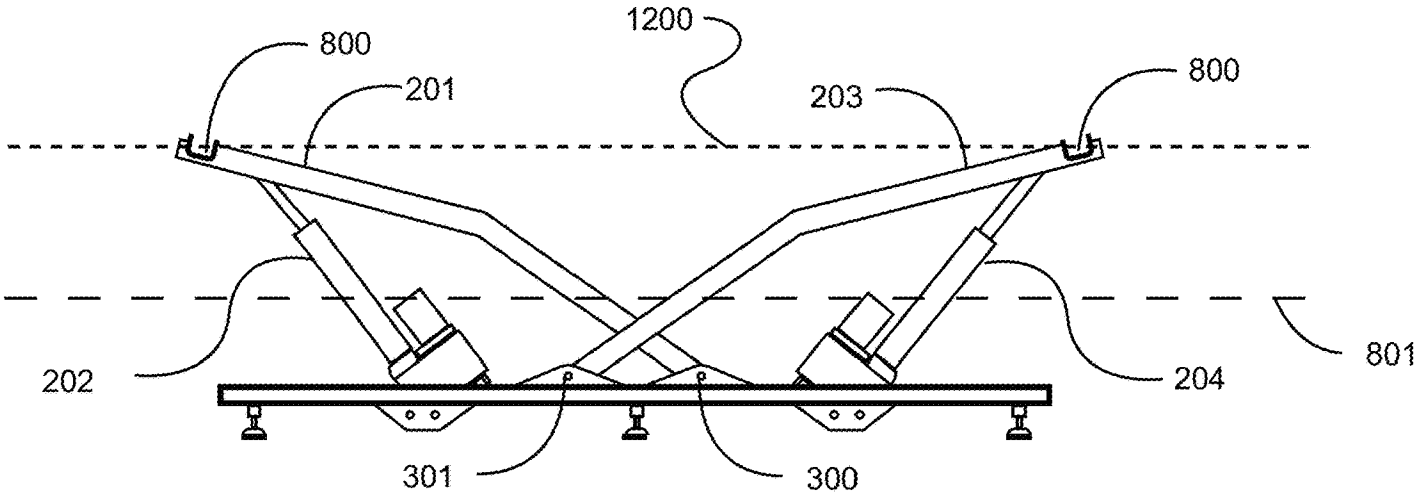
FIG. 12 is an exemplary diagram showing a side view of an exercise machine support structure with both pairs of booms substantially elevated.

FIG. 12 is an exemplary diagram showing a side view of the exercise machine support structure of FIG. 1 with both pairs of booms elevated to support an exercise machine (not shown) at an elevated horizontal plane 1200. More specifically, the elevated first end of the support structure is accomplished by extending the first luffing actuator 202 to cause the parallel booms 201 to rotate clockwise about the first pivot point 300. Similarly, the elevated second end of the support structure is accomplished by extending the second luffing actuator 204 to cause the parallel booms 203 to rotate counterclockwise about the hinge pivot point 301.

As can be readily understood by those skilled in the art, one or both pairs of parallel booms may be raised or lowered simultaneously or sequentially as preferred to create an elevated substantially horizontal plane between the cradles 800 to support the exercise machine not shown at an increased distance from the floor relative to the default elevation 801.

Figure 13:
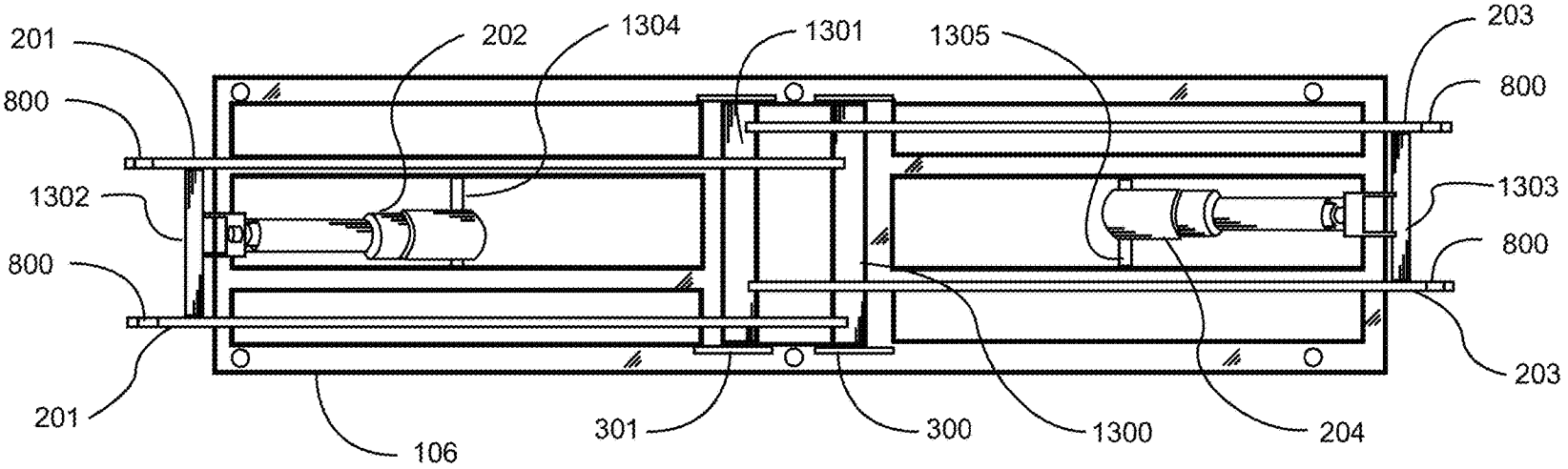
FIG. 13 is an exemplary diagram showing a top view of an exercise machine support structure.

FIG. 13 is an exemplary diagram showing a top view of the exercise machine support structure of FIG. 1. In the drawing, a substantially rectangular exercise machine support structure is shown comprising a frame 106, and pivotably attached thereto at a first pivot point 300 is a first cross member 1300 rotatable about its central axis and to which the proximal ends of a first pair of substantially parallel booms 201 are affixed. A first luffing actuator 202 is pivotably affixed at a first end 1304 to the frame, and at a second end to a yoke 1302 extending between and affixed to the substantially distal ends of the booms. Cradles 800 are shown on the upper edges of the distal ends of the booms, the cradle bearing surfaces intended to support the lifting members of the exercise machine (not shown). Further, a second cross member 1301 is shown extending substantially between and affixed to a second pivot point 301, the cross member being rotatable about its central axis and to which the proximal ends of a second pair of substantially parallel booms 203 are affixed. A second luffing actuator 204 is pivotably affixed at a first end 1305 to the frame, and at a second end to a yoke 1303 extending between and affixed to the substantially distal ends of the booms. Cradles 800 are shown on the upper edges of the distal ends of the booms, the cradle bearing surfaces intended to support the lifting members of the exercise machine not shown.

Figure 14C:
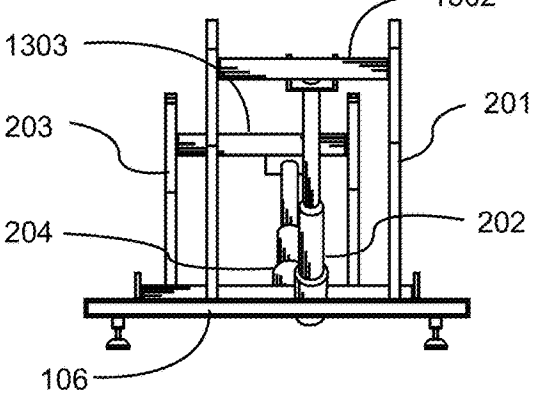
FIG. 14C is an exemplary diagram showing a front view of the first end of an exercise machine support structure with a first pair of booms elevated relative to a second pair of booms.
Figure 14B:
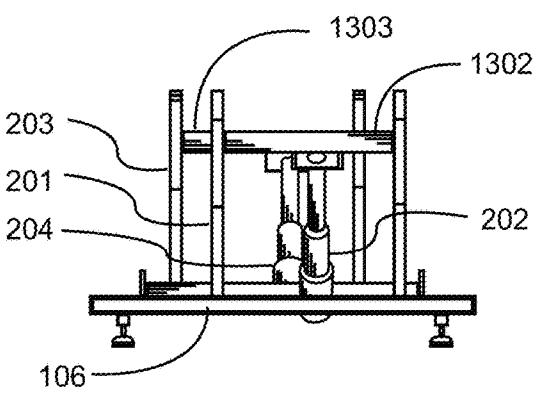
FIG. 14B is an exemplary diagram showing a front view of the first end of an exercise machine support structure with a both pairs of booms positioned at substantially the same elevation.
Figure 14A:
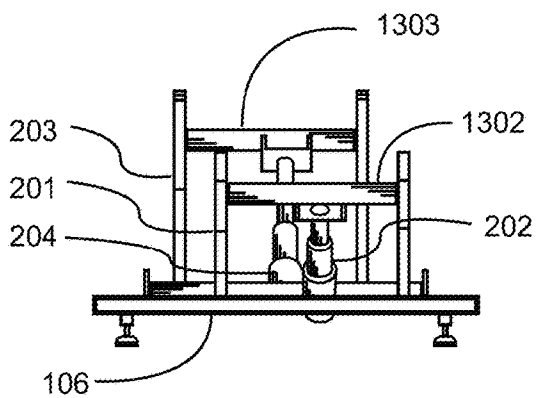
FIG. 14A is an exemplary diagram showing a front view of the first end of an exercise machine support structure with a second pair of booms elevated relative to a first pair of booms.

FIG. 14A is an exemplary diagram showing a front view of the first end of the exercise machine support structure of FIG. 1 with a second pair of booms elevated relative to a first pair of booms. More specifically, the proximal first end of a support structure comprises a frame 106, a first luffing actuator 202 affixed between the frame and a first yoke 1302, the yoke having a central axis transverse to the longitudinal axis of the support structure extending laterally between and affixed to a first pair of parallel booms 201. Further, the distal second end of a support structure comprises a second luffing actuator 204 affixed between the frame and a second yoke 1303, the yoke having a central axis transverse to the longitudinal axis of the support structure extending laterally between and affixed to a second pair of parallel booms 203. In the drawing, the vertical distance between the floor and the first yoke is substantially smaller than the vertical distance between the floor and the second yoke, thereby causing the first proximal end of an exercise machine (not shown) to be tilted at an acute downward angle as previously shown in FIG. 10.

FIG. 14B is an exemplary diagram showing a front view of the first end of the exercise machine support structure of FIG. 1 with a first pair and a second pair of booms positioned at substantially the same elevation. More specifically, the proximal first end of a support structure comprises a frame 106, a first luffing actuator 202 affixed between the frame and a first yoke 1302, the yoke having a central axis transverse to the longitudinal axis of the support structure extending laterally between and affixed to a first pair of parallel booms 201. Further, the distal second end of a support structure comprises a second luffing actuator 204 affixed between the frame and a second yoke 1303, the yoke having a central axis transverse to the longitudinal axis of the support structure extending laterally between and affixed to a second pair of parallel booms 203. In the drawing, the vertical distance between the floor and the first yoke is substantially the same as the vertical distance between the floor and the second yoke, thereby causing the plane formed between the first proximal end and the second distal end of the support structure to be substantially horizontal as previously shown in FIG. 8.

FIG. 14C is an exemplary diagram showing a front view of the first end of the exercise machine support structure of FIG. 1 with a second pair of booms lowered relative to a first pair of booms. More specifically, the proximal first end of a support structure comprises a frame 106, a first luffing actuator 202 affixed between the frame and a first yoke 1302, the yoke having a central axis transverse to the longitudinal axis of the support structure extending laterally between and affixed to a first pair of parallel booms 201. Further, the distal second end of a support structure comprises a second luffing actuator 204 affixed between the frame and a second yoke 1303, the yoke having a central axis transverse to the longitudinal axis of the support structure extending laterally between and affixed to a second pair of parallel booms 203. In the drawing, the vertical distance between the floor and the first yoke is substantially larger than the vertical distance between the floor and the second yoke, thereby causing the first proximal end of an exercise machine not shown to be tilted at an acute upward angle as previously shown in FIG. 11.

Figure 15:
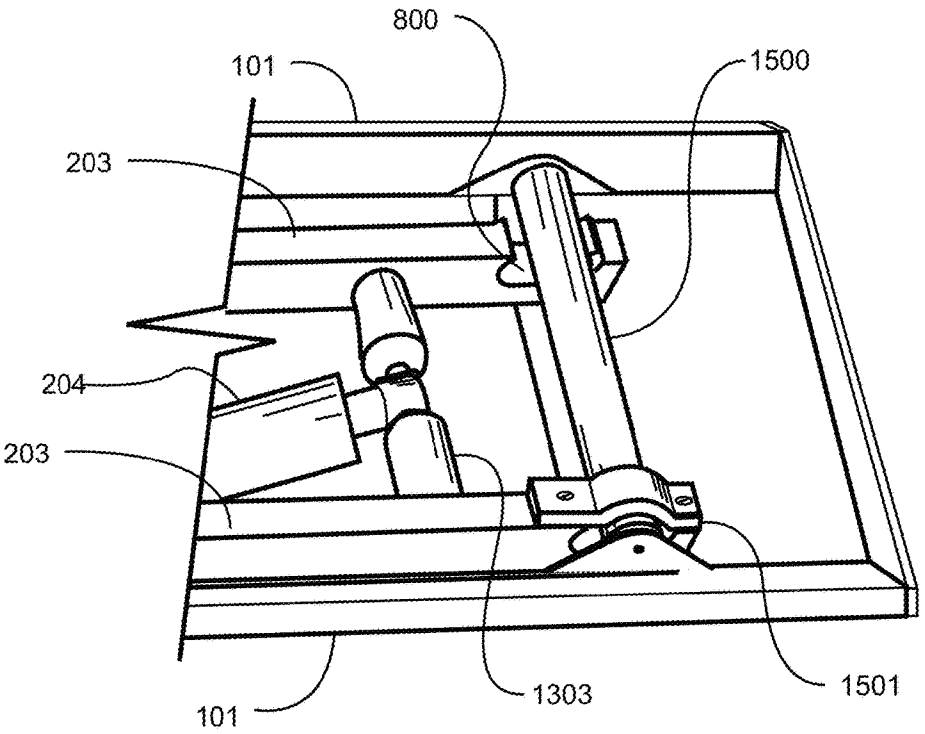
FIG. 15 is an exemplary diagram showing an isometric view of the ends of one pair of booms cradling one lifting member of the exercise machine structure.

FIG. 15 is an exemplary diagram showing an isometric view of the distal ends of a second pair of booms 203 cradling a lifting member of the exercise machine structure of FIG. 1. The structure of an exercise machine comprises at least the previously discussed exercise platforms (not shown), parallel tracks 101 upon which the movable platform (not shown) reciprocally rolls between the first end (not shown) and a second end, and a lifting member 1500 affixed to the exercise machine structure, the lifting member having a central axis substantially transverse to the longitudinal axis of the exercise machine.

It should be noted that the lifting member may be of a cylindrical cross section and may roll about its central axis, or be fixed so as to not roll. Further, the lifting member may be of other than a cylindrical cross section, and still further, a plurality of lifting members, such as a right lifting member affixed to a right side of the exercise structure, and a left lifting member affixed to the left side of the exercise structure may be used to provide for the raising and lowering of the exercise machine by the movement of the distal ends of the booms.

An exercise machine support structure as previously described comprises two opposed pairs of parallel booms, the distal ends of a second pair of booms 203 proximal to the second end of the support structure being shown. A distal second end of a support structure comprises a second luffing actuator 204 affixed between the frame and a second yoke 1303, the yoke having a central axis transverse to the longitudinal axis of the support structure extending laterally between and affixed to a second pair of parallel booms 203.

Cradles 800 are shown with the open upper side of the cradles providing for the insertion of the lifting member 1500 of the exercise machine. The dimension of the cradle as measured in a direction substantially parallel with the longitudinal axis of the support structure is larger than the cross section dimension of the lifting member when measured in a direction transverse to the central axis of the lifting member. The increased length of the cradle relative to the lifting member provides for the central axis of the lifting member to move nearer or further from the distal ends of the booms as the dimension measured between the centers of the cradles of the first pair of booms and second pair of booms increases or decreases throughout the full range of motion of the opposed pairs of booms.

A yoke 1303 extends substantially between and affixes to the distal ends of the booms 203, and serves as a pivotable connection point for the distal end of a luffing actuator 204.

The lower bearing surface of the lifting member may roll upon the upper bearing surface of the cradle if the lifting member is rotationally affixed to the exercise machine, or may slide upon the upper bearing surface of the cradle if the lifting member is statically affixed to the exercise machine.

In one variation, a retaining plate 1501 may be removably affixed to the upper surface of the booms 203, as a means of retaining the lifting member 1500 within the geometry of the cradle 800.

Figure 16C:
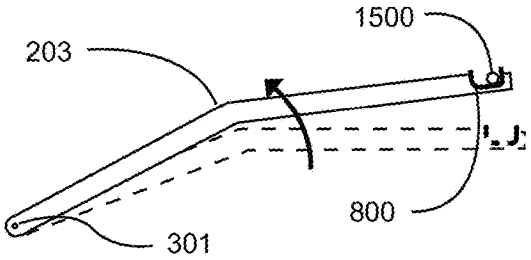
FIG. 16C is an exemplary diagram showing a side view a third location of the lifting member centered within the saddle of the boom.
Figure 16B:
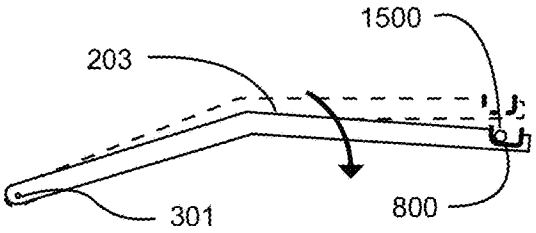
FIG. 16B is an exemplary diagram showing a side view a second location of the lifting member centered within the saddle of the boom.
Figure 16A:
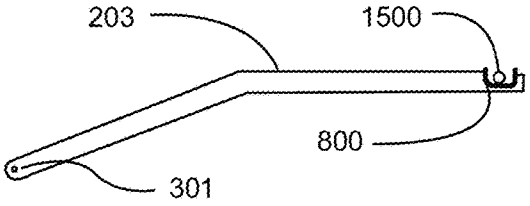
FIG. 16A is an exemplary diagram showing a side view a first location of the lifting member centered within the saddle of the boom.

FIG. 16A is an exemplary diagram showing a side view of a second pair of parallel booms 203 with a proximal end affixed at a pivot point 301 as previously discussed, and a cradle 800 substantially located at the distal end of the booms. A lifting member 1500 is shown positioned within and substantially centered within the cradle.

FIG. 16B is an exemplary diagram showing a side view of a second pair of parallel booms 203 with a proximal end affixed at a pivot point 301 as previously discussed, and a cradle 800 substantially located at the distal end of the booms. As the boom is rotated clockwise about the pivot point 301 relative to its previous position shown in FIG. 16A, the horizontally measured distance between the center of the cradle 800 and the pivot point 301 increases. A lifting member 1500 is therefore shown in a new position within the cradle having moved further away from the distal end of the booms.

FIG. 16C is an exemplary diagram showing a side view of a second pair of parallel booms 203 with a proximal end affixed at a pivot point 301 as previously discussed, and a cradle 800 substantially located at the distal end of the booms. As the boom is rotated counterclockwise about the pivot point 301 relative to its previous position FIG. 16A, the horizontally measured distance between the center of the cradle 800 and the pivot point 301 decreases. A lifting member 1500 is therefore shown in a new position within the cradle having moved closer to the distal end of the booms.

As just described, the two opposed pairs of parallel booms may be independently raised or lowered relative to each other. The geometry of the parallelogram lifting structure provides for the total horizontal dimension measured from the center of one cradle on a first boom to the center of the cradle on a second, opposed boom to lengthen or shorten in conjunction with the independent raising or lowering of the opposed booms throughout the intended range of motion of the booms. The minimum longitudinal dimension of the opposed walls of the cradle must therefore be large enough to accommodate the fixed distance between the lifting members of the exercise machine throughout the full range of motion of the opposed booms.

Figure 17:
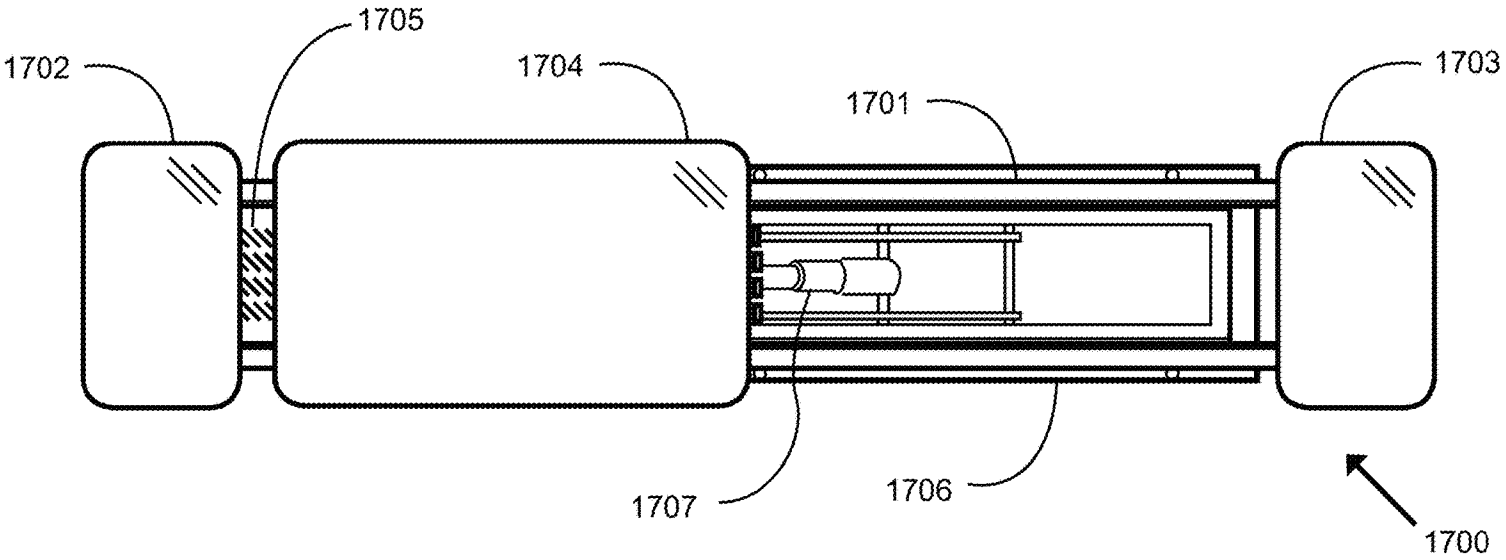
FIG. 17 is an exemplary diagram showing a top view of another exemplary embodiment of an exercise machine and support structure.

FIG. 17 is an exemplary diagram showing a top view of another exemplary embodiment of an exercise machine and support structure. An exercise machine 1700 includes an upper structure comprising a fixed exercise platform 1702 at a first end, a fixed exercise platform 1703 at a second end, one or more tracks 1701 extending substantially the longitudinal length of the structure between the first and second platforms, a slidable platform 1704, which rolls upon the tracks substantially between the first and second fixed platforms, and a frame 1706 that supports the exercise machine and machine support structure. A biasing means 1705 is connected between a first end and the slidable platform 1704 to create a resistance force against which a user would exercise. One actuator 1707 is shown connected between the base supporting structure 1706 and the parallelogram tilting linkage assembly (not shown).

Figure 18:
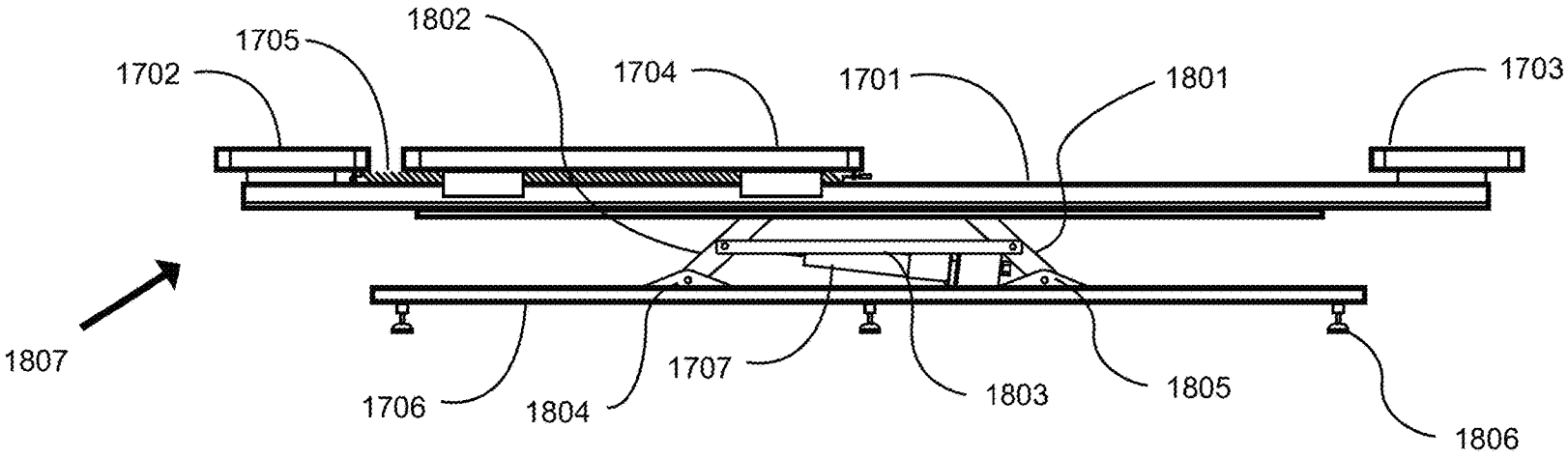
FIG. 18 is an exemplary diagram showing a side view of a variation of an exercise machine and support structure.

FIG. 18 is an exemplary diagram showing a side view of the exercise machine 1807 and support structure of FIG. 17. An exercise machine comprising a first end platform 1702, a second end platform 1703, a platform 1704 slidable upon one or more tracks 1701 therebetween and a biasing means 1705 is supported by a support structure.

The base support structure comprises a frame 1706 and a plurality of feet 1806, and connected thereto a first parallel pair of pivoting stanchions 1802 pivotably attached between the support structure at a first pivot point 1804 and the exercise machine, a second parallel pair of pivoting stanchions 1801 pivotably attached between the support structure at a second pivot point 1805 and the exercise machine, and a pair of parallel linkage members 1803 extending in a direction substantially parallel to the longitudinal axis of the machine between and connected to the respective stanchions of the opposed pairs of stanchions. An actuator 1707 is pivotably connected to the support structure and to one yoke (not shown), the central axis of the yoke being substantially transverse to the longitudinal axis of the machine, and extending substantially between each of the first pair of pivotable stanchions.

Those skilled in the art will readily understand that the pivotable stanchions may be of any preferred length, and the upper end of the opposed pairs of parallel stanchions may angle toward or away from each other, and that the location of the connection points between the parallel linkage members and the pivotable stanchions may be positioned so that the effective extension or retraction of the actuator respectively increases or decreases the vertical distance between the floor and platform 1702 at the first end relative to the platform 1703 at the second end of the exercise machine.

Figure 19:
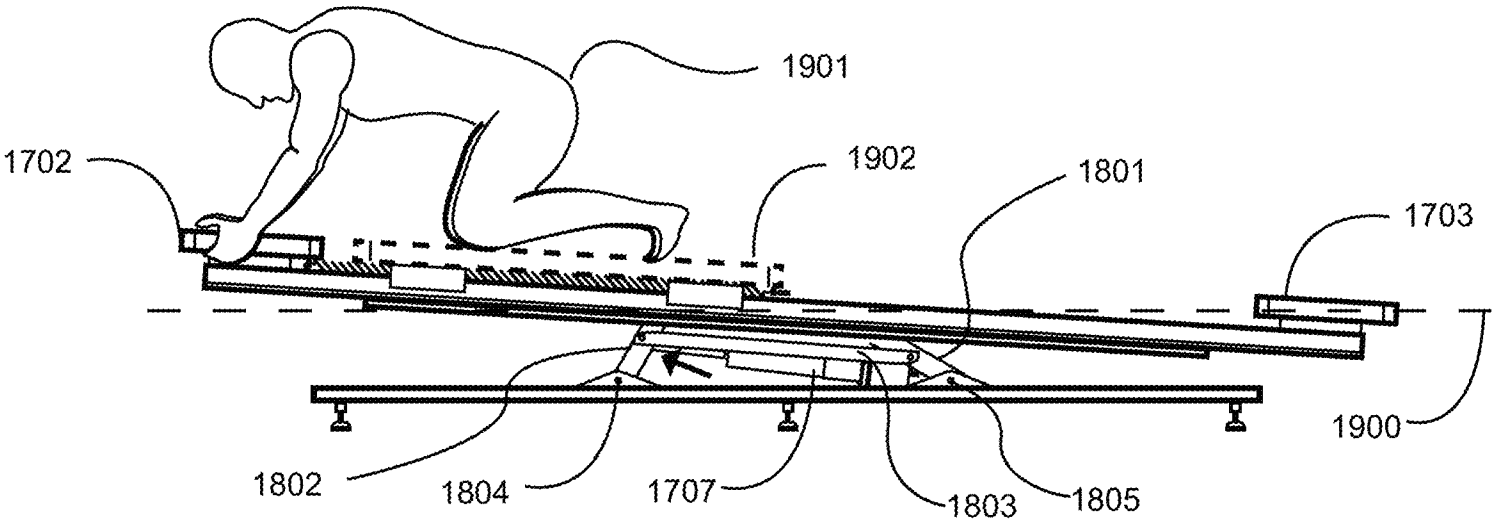
FIG. 19 is an exemplary diagram showing a side view of a variation of an exercise machine and support structure with an exerciser in a starting position on a first inclined end.

It should be noted that movement of the stanchions and linkage just described may be provided by a power actuator, or by an unpowered mechanical actuator manually operable by an exerciser. Therefore, a manual actuation means connected by linkages to one or more pairs of pivotable stanchions may be used in lieu of powered actuators without any difference in providing for an increase or decrease in the vertical distance from the floor to a first end and second end of an exercise machine FIG. 19 is an exemplary diagram showing a side view of the exercise machine and support structure of FIG. 17 with an exerciser 1901 in a starting position on a first inclined end. An exerciser is shown with their hands holding a first stationary platform 1702, with their knees positioned upon the slidable platform 1902. The pivotable stanchions 1802, 1801, each being connected to the opposed pivotable stanchion by a linking member 1803 all move together as a linkage assembly about the pivot points 1804, 1805 in response to lengthening the actuator 1707. In the position shown, the first end of the exercise machine is elevated above the default horizontal plane 1900 while at the same time, the second end of the exercise machine is lowered below the default horizontal plane, thereby increasing the elevation of the first end of the exercise machine relative to the second end.

Figure 20:
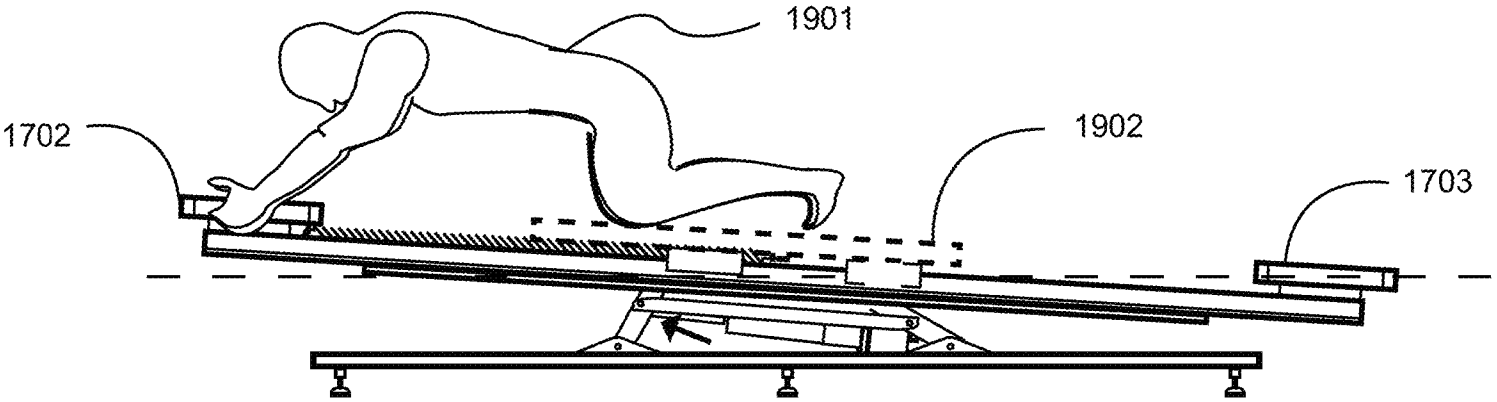
FIG. 20 is an exemplary diagram showing a side view of a variation of an exercise machine and support structure with an exerciser moving on a first inclined end.

FIG. 20 is an exemplary diagram showing a side view of the exercise machine and support structure of FIG. 17 with an exerciser moving on a first inclined end. The exercise machine of the present invention provides for an exerciser 1901 to move from an exercise starting position as just described with respect to FIG. 19 to a new position by pushing the slidable carriage 1902 against the biasing means in a direction opposed to the stationary platform 1702 at the first end of the exercise machine.

Figure 21:
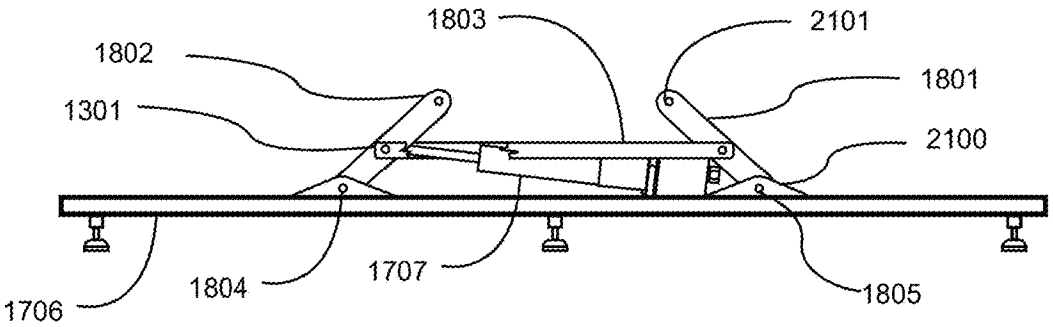
FIG. 21 is an exemplary diagram showing a side view of a variation of an exercise machine support structure with the lift parallelogram positioned for a horizontal exercise machine.

FIG. 21 is an exemplary diagram showing a side view of the exercise machine support structure of FIG. 17 with the lift parallelogram positioned for a horizontal exercise machine. In the drawing, a plurality of mounting flanges 2100 are affixed to the support base, each mounting flange providing for an attachment of a pivotable stanchions 1802, 1801 in such a manner that the pivotable stanchions are free to rotate about their respective pivot points 1804, 1805. A linking member 1803 is shown connected between the opposed pivotable stanchions thereby creating a parallelogram linkage comprising one linking member between one pair of opposed pivotable stanchions, and a second linking member affixed between a second pair of opposed pivotable stanchions. As a means of revealing substantially the full length of the actuator 1707, the drawing shows a portion of the otherwise obscuring linking member 1803 cut away. In the drawing, a yoke (not shown) extending transversely between the first parallel pair of pivotable stanchions 1802 transfers movement caused by extending or retracting the actuator to the linkage assembly. Together, the two pairs of parallel pivotable stanchions, the linkage members affixed between the pivotable stanchions, and the distal end of the actuator form the parallelogram tilt mechanism that provides for the simultaneous movement of the pivotable stanchions about their respective pivot points 1804, 1805 in response to the extension or retraction of the actuator.

The exercise machine (not shown) previously described is pivotally affixed to the distal machine attachment points 2101 on each of the four pivotable stanchions. In response to extension or retraction of the actuator, the exercise machine being connected at the attachment points just described will tilt at a preferred inclination or declination angle relative to the horizontal plane.

Figure 22:
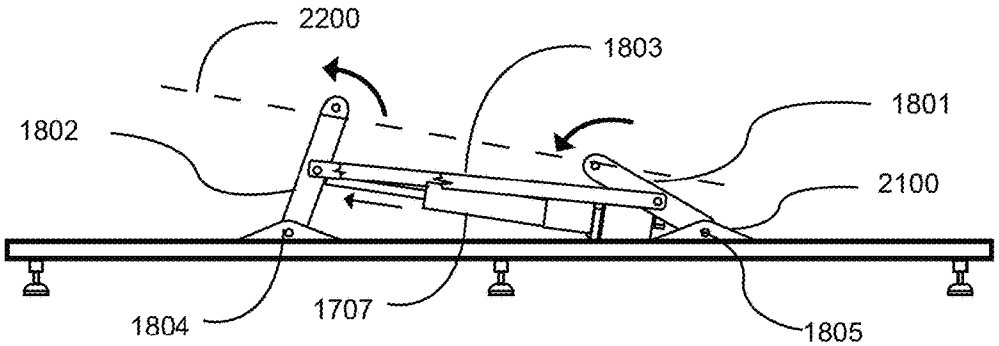
FIG. 22 is an exemplary diagram showing a side view of a variation of an exercise machine support structure with the lift parallelogram positioned for inclining a first end of an exercise machine.

FIG. 22 is an exemplary diagram showing a side view of the exercise machine support structure of FIG. 17 with the lift parallelogram positioned for inclining a first end of an exercise machine. As previously discussed, the pivotable stanchions 1802, 1801 are positioned in the default starting position such that the linkage members 1803 hold the first pair of pivotable stanchions at acute angles relative to the second pair of pivotable stanchions. The actuator 1707, having been extended pushes the power transfer yoke (not shown) and correspondingly, the first pair of pivotable stanchions in a direction towards the first end of the support structure. The distal pivot points of the first pair of pivotable stanchions 1802, being attached to the exercise machine, rotate about their pivot points 1804 such that the distal end rotates in an upward arc, thereby increasing the vertical dimension between the upper attachment points 2101 and lower pivot points 1804 of the pivotable stanchions. Correspondingly, the second pair of pivotable stanchions 1801, each being pivotally connected to the opposed pivotable stanchions by means of the linking member 1803 rotate about their lower pivot points 1805 counterclockwise in a downward arc, thereby decreasing the vertical dimension between the upper attachment points 2101 and lower pivot points 1805 of the pivotable stanchions. The exercise machine, being pivotally attached to the upper attachment points of the pivotable stanchions moves in response to the rotating pivotable stanchions such that the first end of the exercise machine increases the vertical distance to the support structure, while the vertical distance between the second end of the exercise machine and the support base decreases, resulting in an inclination 2200 of the first end of an exercise machine relative to the horizontal plane.

Figure 23:
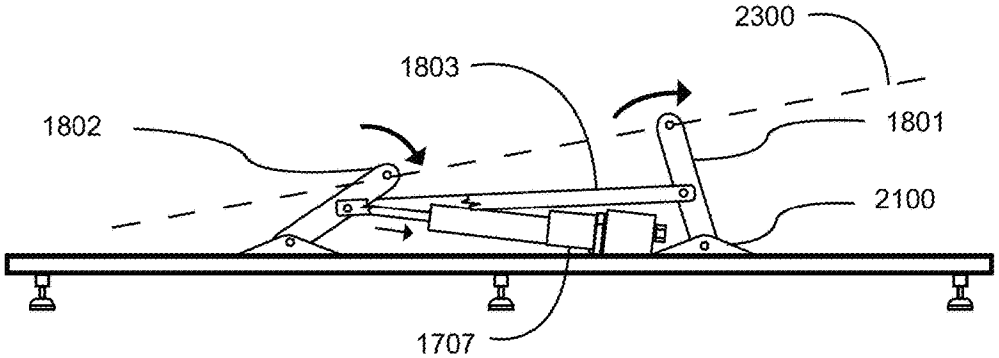
FIG. 23 is an exemplary diagram showing a side view of a variation of an exercise machine support structure with the lift parallelogram positioned for inclining a second end of an exercise machine.

FIG. 23 is an exemplary diagram showing a side view of the exercise machine support structure of FIG. 17 with the lift parallelogram positioned for inclining a second end of an exercise machine. As previously discussed, the pivotable stanchions 1802, 1801 are positioned in the default starting position such that the linkage members 1803 hold the first pair of pivotable stanchions at acute angles relative to the second pair of pivotable stanchions. The actuator 1707, having been retracted pulls the power transfer yoke (not shown) and correspondingly, the first pair of pivotable stanchions in a direction towards the second end of the support structure. The distal pivot points of the first pair of pivotable stanchions 1802, being attached to the exercise machine, rotate about their pivot points 1804 such that the distal end rotates in a downward arc, thereby decreasing the vertical dimension between the upper attachment points 2101 and lower pivot points 1804 of the pivotable stanchions. Correspondingly, the second pair of pivotable stanchions 1801, each being pivotally connected to the opposed pivotable stanchions by means of the linking member 1803 rotate about their lower pivot points 1805 clockwise in an upward arc, thereby increasing the vertical dimension between the upper attachment points 2101 and lower pivot points 1805 of the pivotable stanchions. The exercise machine, being pivotally attached to the upper attachment points of the pivotable stanchions moves in response to the rotating pivotable stanchions such that the second end of the exercise machine increases the vertical distance to the support structure, while the vertical distance between the first end of the exercise machine and the support base decreases, resulting in an inclination 2300 of the second end of the exercise machine relative to the horizontal plane.

Figure 24:
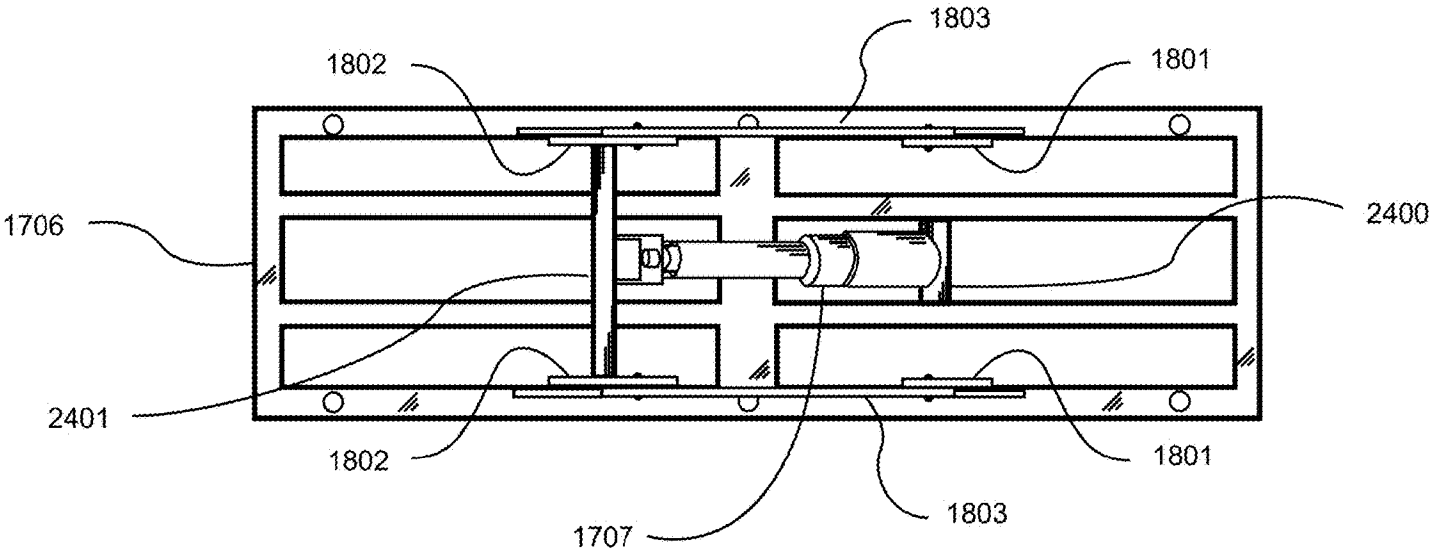
FIG. 24 is an exemplary diagram showing a top view of a variation of an exercise support structure.

FIG. 24 is an exemplary diagram showing a top view of the exercise support structure of FIG. 17. In the drawing, a substantially rectangular exercise machine support structure is shown comprising a frame 1706, and pivotably attached thereto opposed parallel pairs of pivotable stanchions 1801, 1802. Linkage members 1803 are pivotably connected between the opposed pivotable stanchions. An actuator 1707 is pivotably affixed at a first end 2400 to the frame, and at a second end to a movement transfer yoke 2401 with a central axis substantially transverse to the longitudinal axis of the machine extends substantially between and is affixed to the substantially distal ends of a first pair of parallel pivotable stanchions.

Figure 25:
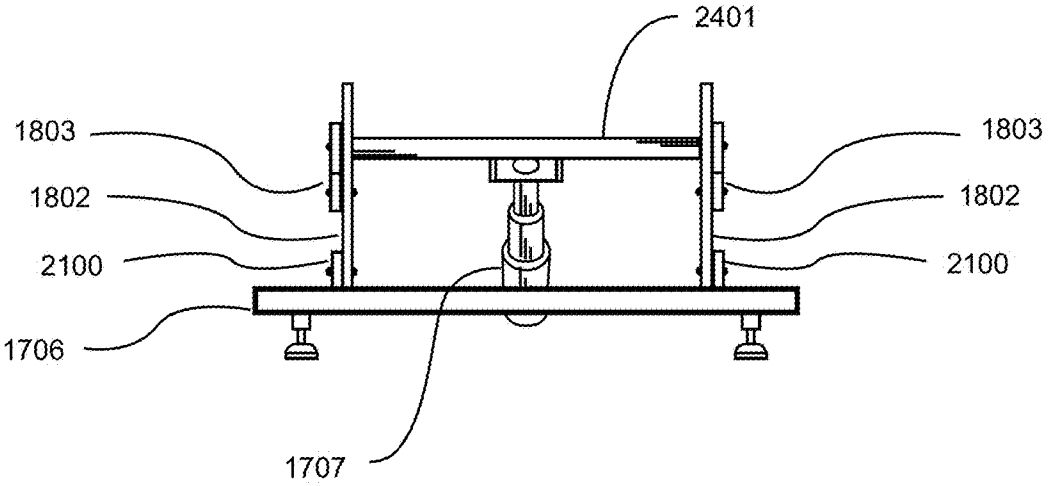
FIG. 25 is an exemplary diagram showing a front view of a variation of an exercise machine support structure.

FIG. 25 is an exemplary diagram showing a front view of a first end of the exercise support structure of FIG. 17. In the drawing, an exercise machine support structure is shown comprising a frame 1706, and pivotably attached thereto a first pair of pivotable stanchions 1802. Linkage members 1803 are pivotably connected between the opposed pivotable stanchions 1802 and 1801 (not shown). An actuator 1707 is affixed at a first end 2400 to the frame, and at a second end to a movement transfer yoke 2401 providing for the transfer of power from the actuator to the linkage structure.

Figure 26:
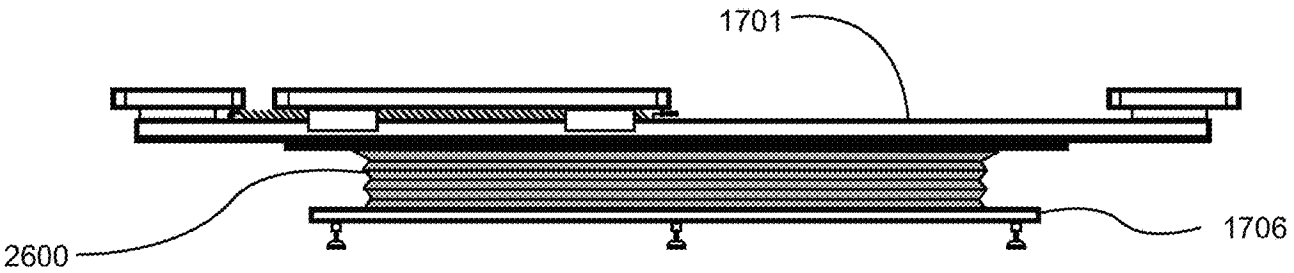
FIG. 26 is an exemplary diagram showing a side view of a variation of an exercise machine and an enclosed support structure.

FIG. 26 is an exemplary diagram showing a side view of the exercise machine of FIG. 17 and an enclosed support structure. In the drawing, the exercise machine as previously described is supported by the lower support base 1706. It is sometimes preferred to conceal and shield the various booms, pivoting stanchions, linkages, actuator and other operable parts of the support structure from the exerciser.

One method of concealment is achieved by affixing a flexible shroud 2600 such as a bellow between the frame of the lower structures and the underside of the rails 1701 and other elements of the exercise machine as previously described, the flexibility of the shroud thereby ensuring that the shroud remains secured between the upper and lower structures throughout the elevation, inclination or declination orientation of the exercise machine to the base support structure.

Figure 27:
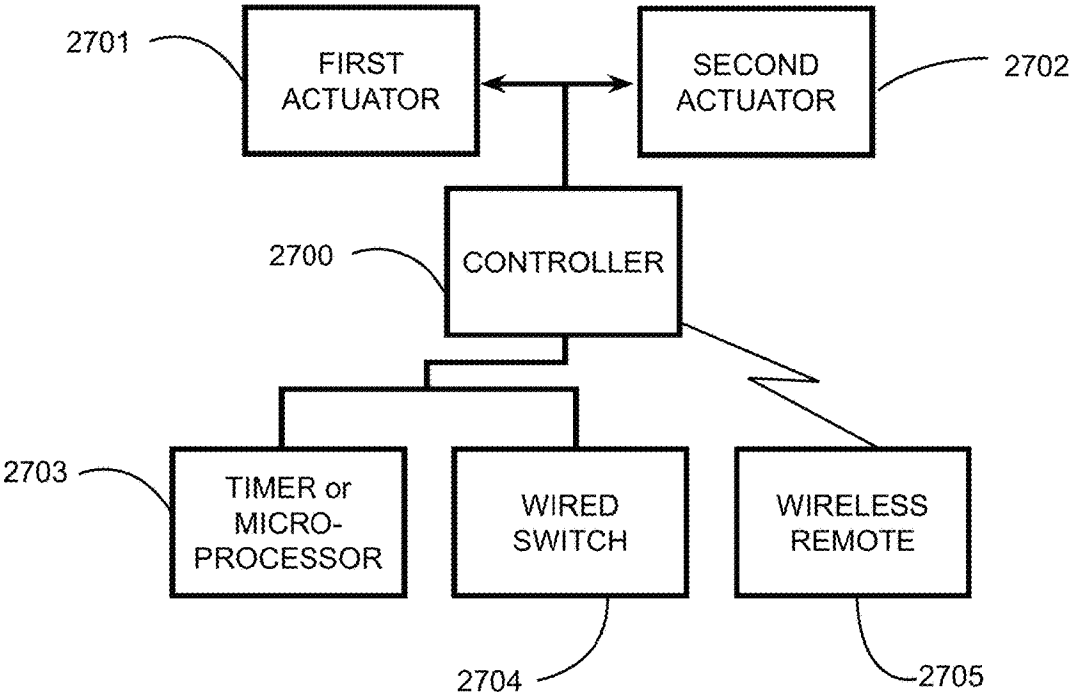
FIG. 27 is an exemplary block diagram of an actuator control unit.

FIG. 27 is an exemplary block diagram of an actuator control unit. A controller may be used to activate one or more actuators. For example, on an exercise machine with two luffing actuators, a controller 2700 may be used to retract a first luffing actuator 2701, and be further used to extend a second luffing actuator 2702, thereby elevating one end of an exercise machine and declining the elevation of the opposed end of an exercise machine. The controller may actuate each actuator sequentially, or simultaneously. In the instance when an exercise machine provides for only one actuator, the controller 2700 would be used to extend or retract the sole actuator 2701.

Signals to the controller may be by wired means, for instance, via a timer or microprocessor 2703, by wired switch 2704, or by means of wireless communication via a wireless remote controller 2705.

Figure 28:
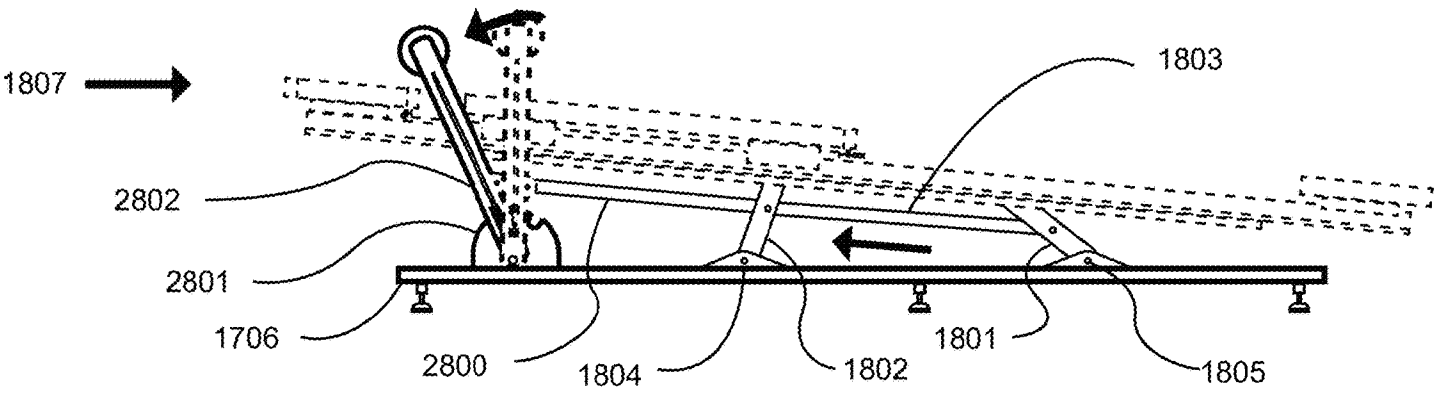
FIG. 28 is an exemplary diagram showing a side view of another exemplary embodiment of an exercise machine and support structure with a manual lever positioned for inclining a first end of the exercise machine.

FIG. 28 is an exemplary diagram showing a side view of another exemplary embodiment of an exercise machine and support structure with a manual lever positioned for inclining a first end of an exercise machine. In the drawing, a structural base frame 1706 provides for the attachment of stationary and pivotable components of the support structure for an exercise machine 1807 as previously described. To prevent duplicating the full description of the exercise machine, which would distract focus of the following descriptions away from the novel manually operable adjustment mechanism, the exercise machine is represented by a dotted line.

A manually operable actuator lever 2802 and lever position selection plate 2801 are affixed to substantially a first end of a support structure frame 1706, the lever being lockable in a plurality of positions by means later described.

As previously described, the base support structure comprises a frame 1706, a first parallel pair of pivoting stanchions 1802 pivotably attached between the support structure at a first pivot point 1804 and the exercise machine, a second parallel pair of pivoting stanchions 1801 pivotably attached between the support structure at a second pivot point 1805 and the exercise machine, and a pair of parallel linkage members 1803 extending in a direction substantially parallel to the longitudinal axis of the machine between and connected to the respective stanchion of the opposed pairs of stanchions.

Further, a power transfer linkage member 2800 is pivotably attached to an actuator lever at one end, and to a first pivotable stanchion 1802 at the other end, thereby providing the transfer of the motion of the actuator lever to the stanchion linkage assembly, the motion being substantially parallel to the longitudinal axis of the exercise machine.

In the drawing, the actuator lever 2802 is shown tilted towards the first end of the exercise machine, having been repositioned from the vertical neutral position indicated by the dashed lever outline. In the instant configuration, the forward repositioning of the manual lever transfers movement to the pivotable stanchions in such a manner as to cause the first end of the exercise machine to incline relative to the second end.

Figure 29:
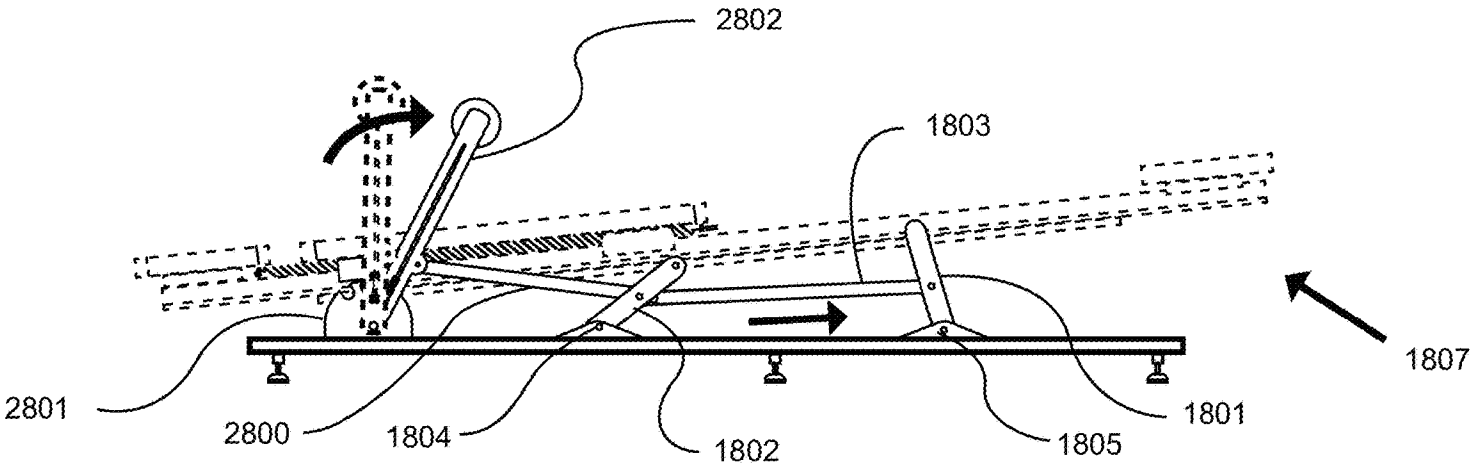
FIG. 29 is an exemplary diagram showing a side view of a variation of an exercise machine and support structure with a manual lever positioned for inclining a second end of an exercise machine.

FIG. 29 is an exemplary diagram showing a side view of the exercise machine and support structure of FIG. 28 with the manual lever positioned for inclining a second end of the exercise machine. In the drawing, a manually operable actuator lever 2802 and lever position selection plate 2801 are shown affixed to substantially a first end of a support structure frame 1706.

Also connected to the support structure frame are a first parallel pair of pivoting stanchions 1802 pivotably attached between the support structure at a first pivot point 1804 and the exercise machine, a second parallel pair of pivoting stanchions 1801 pivotably attached between the support structure at a second pivot point 1805 and the exercise machine, and a pair of parallel linkage members 1803 extending in a direction substantially parallel to the longitudinal axis of the machine between and connected to the respective stanchion of the opposed pairs of stanchions.

Further, a power transfer linkage member 2800 is pivotably attached to an actuator lever at one end, and to a first pivotable stanchion 1802 at the other end, thereby providing the transfer of the motion of the actuator lever to the stanchion linkage assembly, the motion being substantially parallel to the longitudinal axis of the exercise machine.

In the drawing, the actuator lever 2802 is shown tilted away from the first end of the exercise machine, having been repositioned from the vertical neutral position indicated by the dashed lever outline. In the instant configuration, the repositioning of the manual lever away from the first end transfers movement to the pivotable stanchions in such a manner as to cause the first end of the exercise machine to decline relative to the second end.

Figure 30:
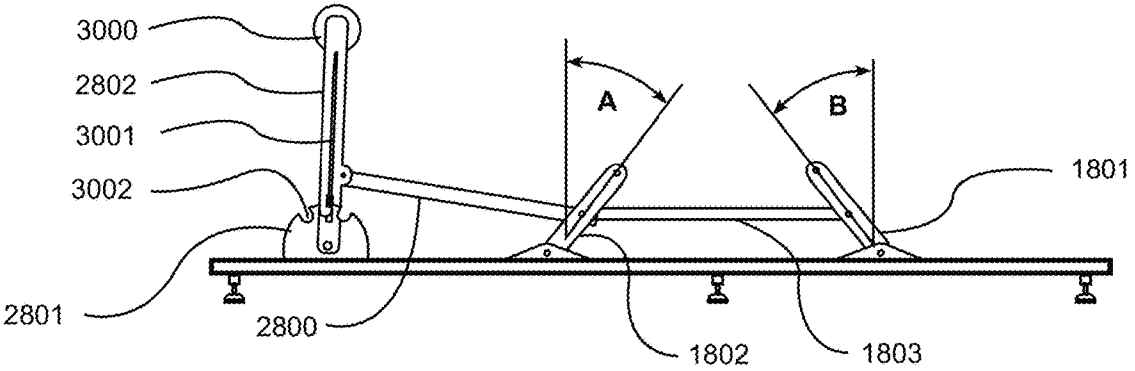
FIG. 30 is an exemplary diagram showing a side view of a variation of a support structure with a manual lever positioned for a horizontal plane of an exercise machine.

FIG. 30 is an exemplary diagram showing a side view of the support structure of FIGS. 28-29 with the manual lever positioned for a horizontal plane of an exercise machine (not shown). In the drawing, a first parallel pair of pivoting stanchions 1802 are pivotably attached to the support structure at a first pivot point 1804, and a second parallel pair of pivoting stanchions 1801 are pivotably attached at a second pivot point 1805, and a pair of parallel linkage members 1803 extend in a direction substantially parallel to the longitudinal axis of the machine between and connected to the respective stanchions of the opposed pairs of stanchions.

It should be noted that the opposed pivotable stanchions just described are angularly positioned toward each other at acute angles to the vertical planes, the first stanchion 1802 pivoted away from the first end of the exercise machine at angle A, and the second stanchion 1805 pivoted towards the first end of the exercise machine at angle B.

Further, a power transfer linkage member 2800 is pivotably attached to an actuator lever at one end, and to a first pivotable stanchion 1802 at the other end, thereby providing the transfer of the motion of the actuator lever to the stanchion linkage assembly, the motion being substantially parallel to the longitudinal axis of the exercise machine. An actuator lever 2802 comprises a handle bar 3000, and a retractable lever position locking member 3001, the locking member selectably engageable with each of a plurality of adjustment plate slots 3002 of a lever position selection plate 2801. A power transfer linkage member 2800 is pivotably attached to an actuator lever at one end, and to a first pivotable stanchion 1802 at the other end, thereby providing the transfer of the motion of the actuator lever to the stanchion linkage assembly.

Figure 31:
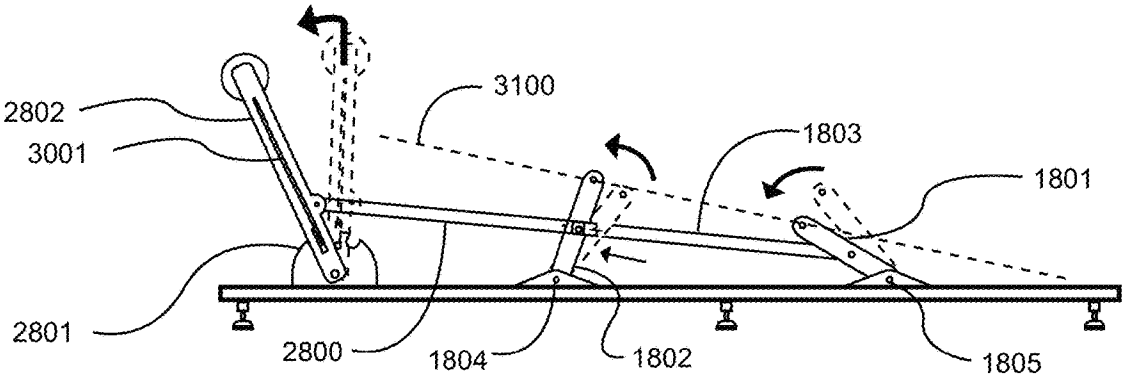
FIG. 31 is an exemplary diagram showing a side view of a variation of a support structure with a manual lever positioned for inclining a first end of an exercise machine.

FIG. 31 is an exemplary diagram showing a side view of the support structure of FIGS. 28-29 with the manual lever positioned for inclining a first end of an exercise machine. In the drawing, the actuator lever 2802 has been rotated towards the first end of the machine relative to the neutral position indicated by the dashed outline of the lever, the rotation being about the pivot point of the lever position selection plate 2801. The actuator lever is first disengaged from the lever position selection plate by manually lifting the retractable lever position locking member 3001 that, in turn, disengaging the locking member from the slot in the position selection plate.

Having disengaged the retractable from the lever position locking member 3001 from the selection plate, the lever is free to manually rotate forward, the forward rotation thereby transmitting the lever motion to rotate the first and second pairs of pivotable stanchions 1802, 1801 in a counterclockwise motion about their respective pivot points 1804, 1805.

As can be readily seen, as the stanchions are rotated in a counterclockwise direction as just described, the vertical distance between the lower and upper pivot points of the first pairs of pivotable stanchions 1802 increase when compared to the neutral position shown in FIG. 30, while at the same time, the vertical distance between the lower and upper pivot points of the second pairs of pivotable stanchions 1801 decrease when compared to the neutral position of FIG. 30, causing the plane 3100 of the exercise machine to be inclined towards the first end of the machine.

Figure 32:
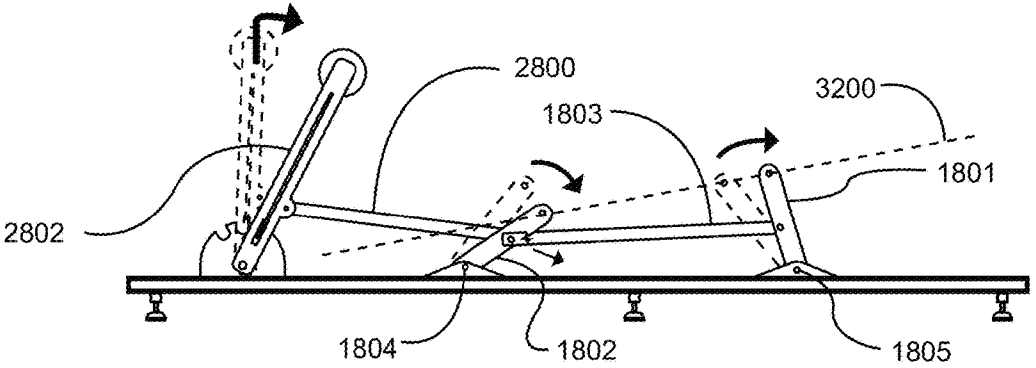
FIG. 32 is an exemplary diagram showing a side view of a variation of a support structure with a manual lever positioned for inclining a second end of an exercise machine.

FIG. 32 is an exemplary diagram showing a side view of the support structure of FIGS. 28-29 with the manual lever positioned for inclining a second end of an exercise machine. In the drawing, the actuator lever 2802 has been rotated away from the first end of the machine relative to the neutral position indicated by the dashed outline of the lever, the rotation being about the pivot point of the lever position selection plate 2801. The actuator lever is first disengaged from the lever position selection plate by manually lifting the retractable lever position locking member 3001 that, in turn, disengaging the locking member from the slot in the position selection plate.

Having disengaged the retractable from the lever position locking member 3001 from the selection plate, the lever is free to manually rotate rearward, the rearward rotation thereby transmitting the lever motion to rotate the first and second pairs of pivotable stanchions 1802, 1801 in a clockwise motion about their respective pivot points 1804, 1805.

As can be readily seen, as the stanchions are rotated in a clockwise direction as just described, the vertical distance between the lower and upper pivot points of the first pairs of pivotable stanchions 1802 decrease when compared to the neutral position of FIG. 30, while at the same time, the vertical distance between the lower and upper pivot points of the second pairs of pivotable stanchions 1801 increase when compared to the neutral position of FIG. 30, causing the plane 3200 of the exercise machine to be inclined towards the second end of the machine.

Figure 33:
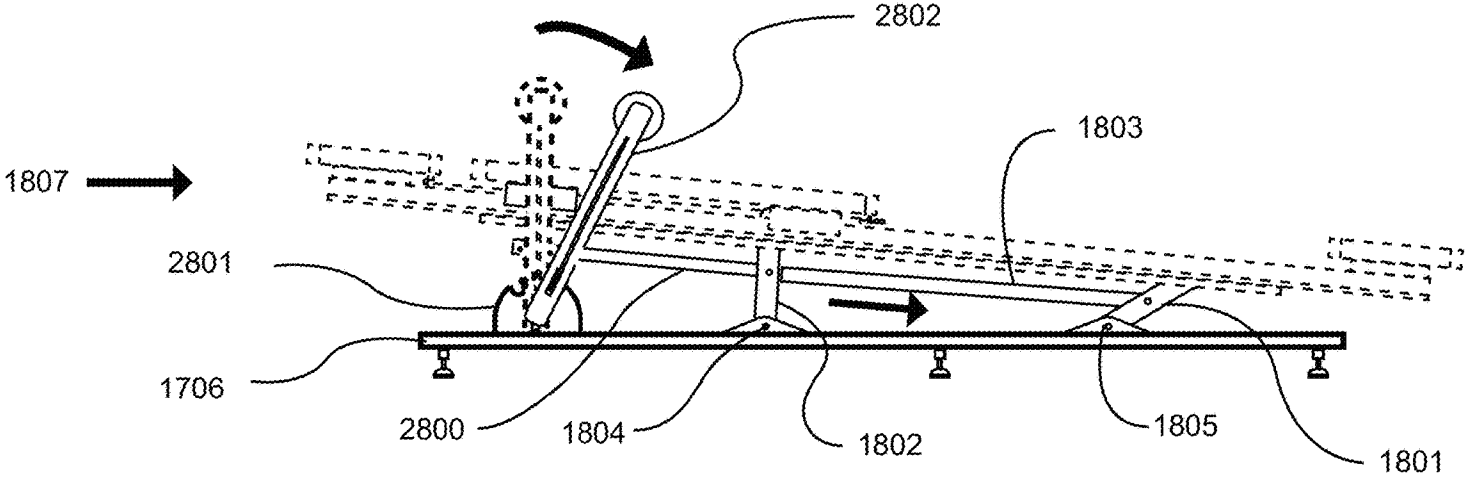
FIG. 33 is an exemplary diagram showing a side view of yet another exemplary embodiment of an exercise machine and support structure with a manual lever positioned for inclining a first end of the exercise machine.

FIG. 33 is an exemplary diagram showing a side view of yet another exemplary embodiment of an exercise machine and support structure with a manual lever positioned for inclining a first end of an exercise machine. In the drawing, a structural base frame 1706 provides for the attachment of stationary and pivotable components of the support structure for an exercise machine 1807 as previously described. To prevent duplicating the full description of the exercise machine, which would distract focus of the following descriptions away from the novel manually operable adjustment mechanism, the exercise machine is represented by a dotted line.

A manually operable actuator lever 2802 and lever position selection plate 2801 are affixed to substantially a first end of a support structure frame 1706, the lever being lockable in a plurality of positions by means later described.

As previously described, a first parallel pair of pivoting stanchions 1802 are pivotably attached between the support structure at a first pivot point 1804 and the exercise machine, a second parallel pair of pivoting stanchions 1801 are pivotably attached between the support structure at a second pivot point 1805 and the exercise machine, and a pair of parallel linkage members 1803 extend in a direction substantially parallel to the longitudinal axis of the machine between and connected to the respective stanchion of the opposed pairs of stanchions.

Further, a power transfer linkage member 2800 is pivotably attached to an actuator lever 2802 at one end, and to a first pivotable stanchion 1802 at the other end, thereby providing the transfer of the motion of the actuator lever to the stanchion linkage assembly, the motion being substantially parallel to the longitudinal axis of the exercise machine.

In the drawing, the actuator lever 2802 is shown tilted away from the first end of the exercise machine, having been repositioned from the vertical neutral position indicated by the dashed lever outline. In the instant configuration, the rearward repositioning of the manual lever transfers movement to the pivotable stanchions in such a manner as to cause the first end of the exercise machine to incline relative to the second end.

Figure 34:
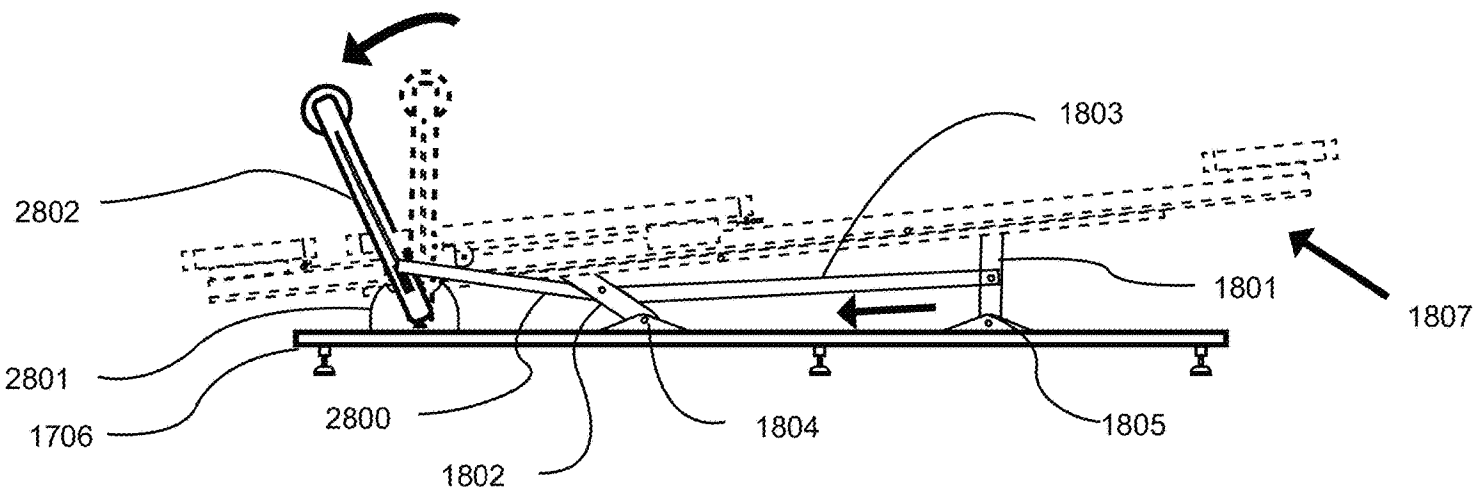
FIG. 34 is an exemplary diagram showing a side view of a variation of an exercise machine and support structure with a manual lever positioned for inclining a second end of an exercise machine.

FIG. 34 is an exemplary diagram showing a side view of the exercise machine and support structure of FIG. 33 with the manual lever positioned for inclining a second end of an exercise machine. In the drawing, a manually operable actuator lever 2802 and lever position selection plate 2801 are shown affixed to substantially a first end of a support structure frame 1706.

A first parallel pair of pivoting stanchions 1802 are pivotably attached between the support structure at a first pivot point 1804 and the exercise machine, a second parallel pair of pivoting stanchions 1801 are pivotably attached between the support structure at a second pivot point 1805 and the exercise machine, and a pair of parallel linkage members 1803 extend in a direction substantially parallel to the longitudinal axis of the machine between and connected to the respective stanchion of the opposed pairs of stanchions.

Further, a power transfer linkage member 2800 is pivotably attached to an actuator lever at one end, and to a first pivotable stanchion 1802 at the other end, thereby providing the transfer of the motion of the actuator lever to the stanchion linkage assembly, the motion being substantially parallel to the longitudinal axis of the exercise machine.

In the drawing, the actuator lever 2802 is shown tilted towards the first end of the exercise machine, having been repositioned from the vertical neutral position indicated by the dashed lever outline. In the instant configuration, the repositioning of the manual lever away from the first end transfers movement to the pivotable stanchions in such a manner as to cause the first end of the exercise machine to decline relative to the second end.

Figure 35:
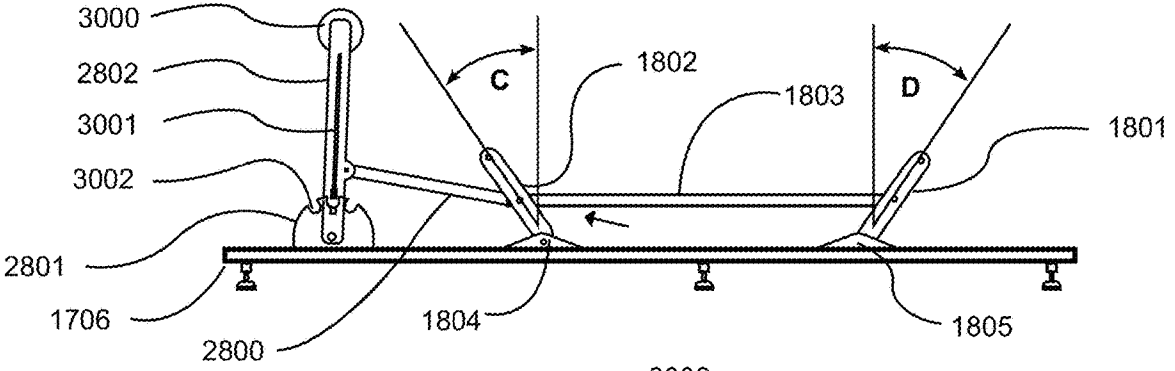
FIG. 35 is an exemplary diagram showing a side view of a variation of a support structure with a manual lever positioned for a horizontal plane of an exercise machine.

FIG. 35 is an exemplary diagram showing a side view of the support structure of FIGS. 33-34 with the manual lever positioned for a horizontal plane of an exercise machine. In the drawing, a first parallel pair of pivoting stanchions 1802 are pivotably attached to the support structure at a first pivot point 1804, and a second parallel pair of pivoting stanchions 1801 are pivotably attached at a second pivot point 1805, and a pair of parallel linkage members 1803 extend in a direction substantially parallel to the longitudinal axis of the machine between and connected to the respective stanchions of the opposed pairs of stanchions.

It should be noted that the opposed pivotable stanchions just described are angularly positioned away each other at the angles shown relative to the vertical planes, the first stanchion 1802 pivoted toward the first end of the exercise machine at angle C, and the second stanchion 1805 pivoted away from the first end of the exercise machine at angle D.

Figure 36:
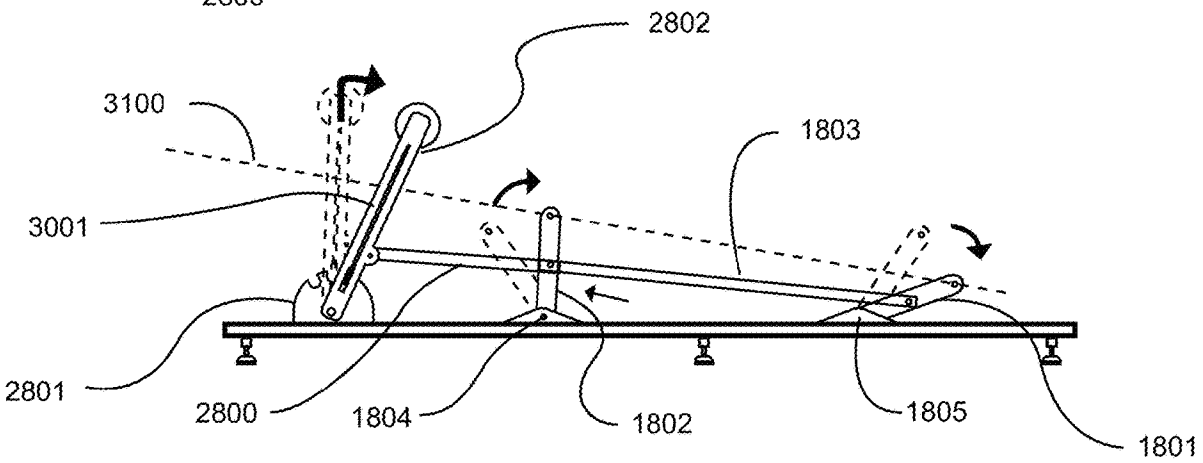
FIG. 36 is an exemplary diagram showing a side view of a variation of a support structure with a manual lever positioned for inclining a first end of an exercise machine.

Further, a power transfer linkage member 2800 is pivotably attached to an actuator lever at one end, and to a first pivotable stanchion 1802 at the other end, thereby providing the transfer of the motion of the actuator lever to the stanchion linkage assembly, the motion being substantially parallel to the longitudinal axis of the exercise machine. An actuator lever 2802 comprises a handle bar 3000, and a retractable lever position locking member 3001, the locking member selectably engageable with each of a plurality of adjustment plate slots 3002 of a lever position selection plate 2801. A power transfer linkage member 2800 is pivotably attached to an actuator lever at one end, and to a first pivotable stanchion 1802 at the other end, thereby providing the transfer of the motion of the actuator lever to the stanchion linkage assembly FIG. 36 is an exemplary diagram showing a side view of the support structure of FIGS. 33-34 with the manual lever positioned for inclining a first end of an exercise machine. In the drawing, the actuator lever 2802 has been rotated away the first end of the machine relative to the neutral position indicated by the dashed outline of the lever, the rotation being about the pivot point of the lever position selection plate 2801. The actuator lever is first disengaged from the lever position selection plate by manually lifting the retractable lever position locking member 3001 that, in turn, disengaging the locking member from the slot in the position selection plate.

Having disengaged the retractable lever position locking member 3001 from the selection plate, the lever is free to manually rotate rearward, the rearward rotation thereby transmitting the lever motion to rotate the first and second pairs of pivotable stanchions 1802, 1801 in a clockwise motion about their respective pivot points 1804, 1805.

As can be readily seen, as the stanchions are rotated in a clockwise direction as just described, the vertical distance between the lower and upper pivot points of the first pairs of pivotable stanchions 1802 increase when compared to the neutral position of FIG. 35, while at the same time, the vertical distance between the lower and upper pivot points of the second pairs of pivotable stanchions 1801 decrease when compared to the neutral position of FIG. 35, causing the plane 3100 of the exercise machine to be inclined towards the first end of the machine.

Figure 37:
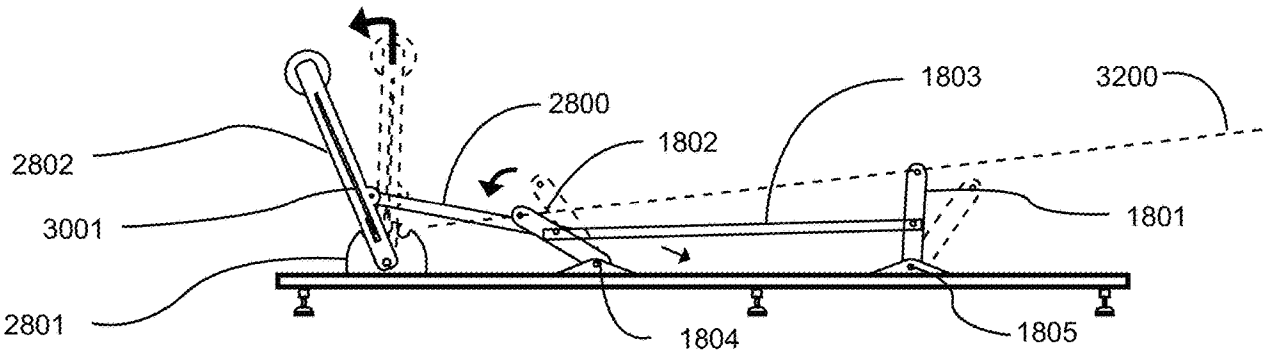
FIG. 37 is an exemplary diagram showing a side view of a variation of a support structure with a manual lever positioned for inclining a second end of an exercise machine.

FIG. 37 is an exemplary diagram showing a side view of the support structure of FIGS. 33-34 with the manual lever positioned for inclining a second end of an exercise machine. In the drawing, the actuator lever 2802 has been rotated towards the first end of the machine relative to the neutral position indicated by the dashed outline of the lever, the rotation being about the pivot point of the lever position selection plate 2801.

Having disengaged the retractable lever position locking member 3001 from the selection plate as previously described, the lever is free to manually rotate forward, the forward rotation thereby transmitting the lever motion to rotate the first and second pairs of pivotable stanchions 1802, 1801 in a counterclockwise motion about their respective pivot points 1804, 1805.

As can be readily seen, as the stanchions are rotated in a counterclockwise direction as just described, the vertical distance between the lower and upper pivot points of the first pairs of pivotable stanchions 1802 decrease when compared to the neutral position of FIG. 35, while at the same time, the vertical distance between the lower and upper pivot points of the second pairs of pivotable stanchions 1801 increase when compared to the neutral position of FIG. 35, causing the plane 3200 of the exercise machine to be inclined towards the second end of the machine.

Figure 38B:
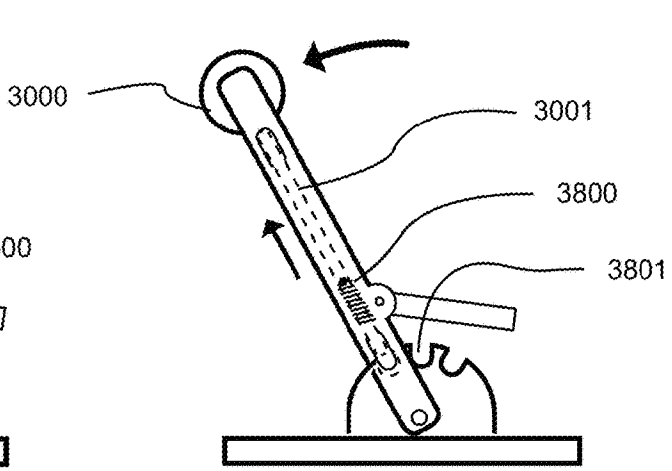
FIG. 38B is an exemplary diagram showing a side view of a manual adjustment lever in a second, adjusted position.
Figure 38A:
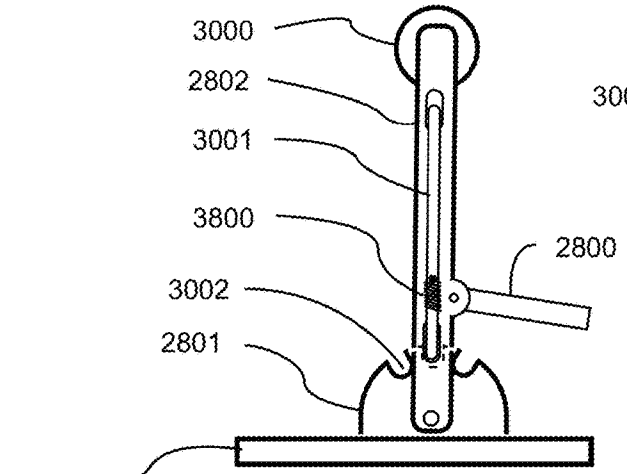
FIG. 38A is an exemplary diagram showing a side view of a manual adjustment lever in a first neutral position.

FIG. 38A is an exemplary diagram showing a side view of a manual adjustment lever in a first neutral position.

The actuator lever assembly comprises a manually operable actuator lever 2802, a handle bar 3000, a retractable lever position locking member 3001, the locking member selectably engageable with each of a plurality of adjustment plate slots 3002 of a lever position selection plate 2801. A power transfer linkage member 2800 is pivotably attached to an actuator lever at one end, and to a first pivotable stanchion (not shown). The locking member 3001 is slidably affixed to the lever 2802, the upper and lower ends of the locking member extending through openings in the lever. The upper extended end of the locking member may be grasped by an exerciser's hand and pulled upward relative to the lever. Upon pulling the locking member upward, the lower extended end, having extended through an opening in the lever and into one of a plurality of adjustment plate slots 3002 of a lever position selection plate 2801, raises the extended lower end out of the slot, thereby disengaging the locking member allowing the lever assembly to rotate forward or rearward.

A spring 3800 secured between the actuator lever 2802 and retractable lever position locking member 3001 provides for a biasing force to retain the locking member in a preferred slot of the adjustment plate 2801 when the exerciser lowers the upper extension of the locking member after repositioning.

FIG. 38B is an exemplary diagram showing a side view of the manual adjustment lever of FIG. 38A in a second, adjusted position.

The drawing shows that the upper end of actuator lever assembly just described is rotated counterclockwise while the retractable lever position locking member 3001, shown as a dashed outline to indicate that the locking member has been disengaged from one adjustment plate slot 3801, is in a retracted position that extends the retaining spring 3800 during the repositioning.

Those skilled in the art will appreciate that the body of art related to locking and unlocking rotatable levers about a slotted plate, and biasing means to retain locking members in a locked state is large and well known. It is not the intention of the description herein to limit the adjustment lever details to those described, and any number of alternative mechanical linkages and interlocking components that would allow for engaging and disengaging a lever in various positions may be used.

Figure 39B:
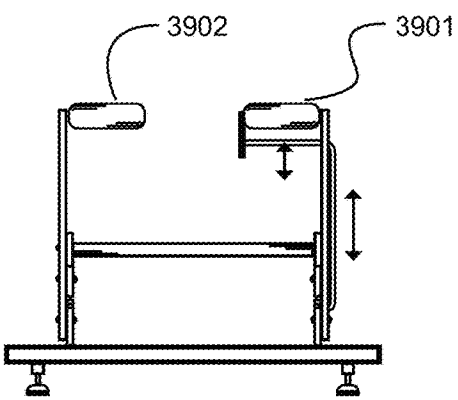
FIG. 39B is an exemplary diagram showing one front view of exemplary right and left split handles for manually inclining or declining an exercise machine.
Figure 39A:
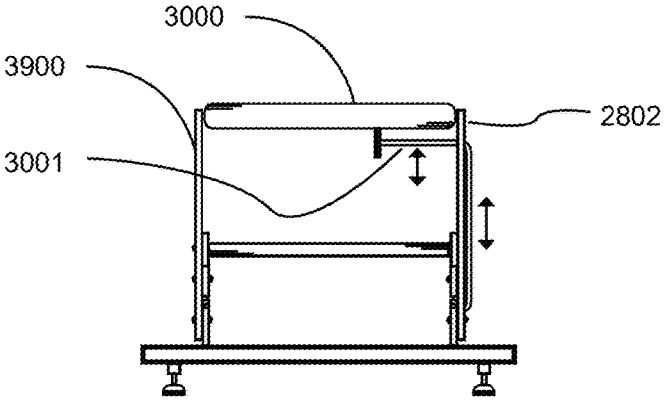
FIG. 39A is an exemplary diagram showing one front view of one single transverse handle for manually inclining or declining an exercise machine.

FIG. 39A is an exemplary diagram showing one front view of one single transverse handle for manually inclining or declining an exercise machine.

The use of a transverse bar on Pilates exercise machines are well known, and are used by exercisers to push or pull against during the performance of an exercise. However, transverse bars on Pilates apparatuses are not used for the purpose of tilting the Pilates apparatus. No Pilates apparatus teaches inclination or declination of the exercise plane, and rather the Pilates Method specifically teaches away from inclining an apparatus, espousing only exercises on a horizontal apparatus.

In the drawing, the front view of a handle bar 3000 affixed to a manual actuator lever 2802 on the right side as previously described is shown. Further, the inward extension of the retractable lever position locking member 3001 is shown below a portion of the single transverse handle bar. As previously described, the retractable lever position locking member may be raised towards the handle bar to disengage the lower portion from each of a plurality of adjustment plate slots.

In the configuration shown, the handle bar extends transversely substantially across the exercise machine attaching to a left side lever 3900 shown without a locking member. The actuator lever 2802 and the left side lever 3900 are both connected to the linkage assemblies as previously described by means of equal length power transfer linkage members, and therefore the right and left levers to which the handle bar is connected move in parallel during any adjustment, and remain parallel and static when the locking member is locked in a preferred position.

FIG. 39B is an exemplary diagram showing one front view of right and left split handles for manually inclining or declining an exercise machine.

The single, transverse handle bar just described will not allow an exerciser to pass their body through and between the opposed right and left levers. Therefore, it may be preferred to split the handle bars to allow for an exerciser to perform exercises between the handlebars.

The drawing shows a first handle bar 3901 secured to a first actuator lever assembly comprising a retractable locking member, and a second handle bar 3902 affixed to a second lever without a retractable locking member. The handle bars 3901, 3902, being both connected to the linkage assemblies as previously described, move in parallel during any adjustment, and remain parallel and static when the locking member is locked in a preferred position.

B. Operation of Preferred Embodiment

In use, an exerciser may first use the controller to control the actuator or actuators to adjust the relative vertical positions of the first and second ends of the exercise machine for a desired elevation and inclination of the exercise machine relative to a horizontal plane, as appropriate for the exercise to be performed. Alternatively, in embodiments in which a manual actuator lever is employed, the exerciser may rotate the actuator lever to the position corresponding to the desired inclination of the exercise machine for the exercise to be performed and lock it in place. Also alternatively, an exerciser having stature or a condition requiring the exercise machine to be lowered for mounting may do so and may mount the exercise machine prior to adjusting the inclination. Obviously, however, caution should be taken in adjusting the elevation and inclination of the exercise machine while an exerciser is mounted thereon in order to avoid falling as the exercise machine is in motion.

Once the exercise machine is adjusted to the desired elevation and inclination, the exerciser may mount the exercise machine and perform any desired exercises targeting various muscles and muscle groups. By way of example, and with reference to FIGS. 19 and 20, an exerciser may perform one type of exercise by first raising a first end of the exercise machine to create a slight incline relative to a second end of the machine. The exerciser may then mount the exercise machine kneeling on the slidable platform 1902 while leaning forward and grasping the fixed platform 1702 as shown in FIG. 19. The exerciser may then extend the lower portion of the exerciser's body in the direction away from the fixed platform 1702 while continuing to grasp the platform 1702 causing the slidable platform 1902 to slide toward platform 1703. The exerciser may then reverse the movement returning to the initial position shown in FIG. 19 and repeat as desired. The inclination of the exercise machine and the resistance to the exerciser's movement provided by the biasing member (FIG. 18) may be adjusted to increase or decrease the muscle exertion required to perform the exercise.

While one example of a useful exercise has been provided above, the present invention is not intended to be limited with respect to any particular exercises that may be performed using the exercise machine of the present invention. To the contrary, persons skilled in the art will realize that a wide variety of useful exercises may be performed using an exercise machine embodying the present invention.

Unless otherwise defined, all technical and scientific terms used herein have the same meaning as commonly understood by one of ordinary skill in the art to which this invention belongs. Although methods and materials similar to or equivalent to those described herein can be used in the practice or testing of the tilting exercise machine, suitable methods and materials are described above. All publications, patent applications, patents, and other references mentioned herein are incorporated by reference in their entirety to the extent allowed by applicable law and regulations. The tilting exercise machine may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

an upper frame having at least one track, a first end and a second end opposite the first end;

a movable platform moveably connected to the at least one track and adapted to be moveable along at least a portion of the at least one track;

a base having a first end and a second end, wherein the first end of the base is closer to the first end of the upper frame than the second end of the base, and wherein the second end of the base is closer to the second end of the upper frame than the first end of the base;

a first boom having a first end pivotably connected to the base and a second end connected to the upper frame;

a second boom having a first end pivotably connected to the base and a second end connected to the upper frame;

wherein the second end of the first boom is closer to the first end of the upper frame than the second end of the second boom;

a first actuator having a first end connected to the base and a second end connected to the first boom; and a second actuator having a first end connected to the base and a second end connected to the second boom;

wherein the first actuator is operable to cause the first end of the first boom to rotate about a first pivotable connection to the base and thereby cause the second end of the first boom to move in a vertical direction relative to the base;

wherein the second actuator is operable to cause the first end of the second boom to rotate about a second pivotable connection to the base and thereby cause the second end of the second boom to move in the vertical direction relative to the base;

whereby the first end and the second end of the upper frame are selectively moveable in the vertical direction to elevate the exercise machine with respect to the base and to provide the exercise machine with an angle of inclination between a first end and a second end of the exercise machine relative to a horizontal plane;

wherein the first pivotable connection is closer to the second end of the base than the first end of the base, and wherein the second pivotable connection is closer to the first end of the base than the second end of the base.

2. The exercise machine of claim 1, wherein:

the first boom comprises a first pair of parallel booms each having a first end pivotably connected to the base and a second distal end connected to the upper frame at or near the first end of the upper frame;

the second boom comprises a second pair of parallel booms each having a first end pivotably connected to the base and a second distal end connected to the upper frame at or near the second end of the upper frame;

wherein the first pair and second pair of parallel booms are connected to the base opposing each other.

3. The exercise machine of claim 2, including:

a first yoke extending transversely between and connecting the first pair of parallel booms near respective second ends of the first pair of parallel booms, the first actuator pivotably connected to the first yoke, the first yoke thereby pivotably connecting the first actuator to the first pair of parallel booms; and a second yoke extending transversely between and connecting the second pair of parallel booms near their second ends of the second pair of parallel booms, the second actuator pivotably connected to the second yoke, the second yoke thereby pivotably connecting the second actuator to the second pair of parallel booms.

4. The exercise machine of claim 1, wherein the first actuator and the second actuator are luffing actuators.

5. The exercise machine of claim 1, wherein the first actuator and the second actuator are comprised of a linear actuator, a non-linear actuator, a hydraulic actuator, a pneumatic actuator, an electric actuator, or a mechanical actuator.

6. The exercise machine of claim 1, further comprising a controller, wherein the controller is operable to independently control the first actuator and the second actuator.

7. The exercise machine of claim 1, wherein the first boom is pivotably connected to the first actuator and the second boom is pivotably connected to the second actuator.

8. The exercise machine of claim 1, including:

a first lifting member connected to the upper frame near the first end and extending transversely to a longitudinal axis of the upper frame;

a second lifting member connected to the upper frame near the second end and extending transversely to the longitudinal axis of the upper frame; and wherein the first boom and the second boom each has a cradle near a respective second end, the cradle of the first boom in contact with and supporting the first lifting member, and the cradle of the second boom in contact with and supporting the second lifting member.

9. The exercise machine of claim 1, further comprising a biasing member connected to the movable platform to provide a resistance force to the movable platform.

10. An exercise machine, comprising:

an upper frame having at least one track, a first end and a second end opposite the first end;

a movable platform moveably connected to the at least one track and adapted to be moveable along at least a portion of the at least one track;

a base having a first end and a second end, wherein the first end of the base is closer to the first end of the upper frame than the second end of the base;

a first boom having a first end pivotably connected to the base and a second end connected to the upper frame at or near the first end of the upper frame;

a second boom having a first end pivotably connected to the base and a second end connected to the upper frame;

wherein the second end of the first boom is closer to the first end of the upper frame than the second end of the second boom;

wherein the first boom extends in a first direction that extends upwardly and towards the first end of the upper frame;

wherein the second boom extends in a second direction that extends upwardly and towards the second end of the upper frame;

a first actuator having a first end connected to the base and a second end connected to the first boom;

a second actuator having a first end connected to the base and a second end connected to the second boom;

wherein the first boom is pivotably connected to the first actuator and the second boom is pivotably connected to the second actuator;

wherein the first actuator is operable to cause the first end of the first boom to rotate about a first pivotable connection to the base and thereby cause the second end of the first boom to move in a vertical direction relative to the base;

wherein the second actuator is operable to cause the first end of the second boom to rotate about a second pivotable connection to the base and thereby cause the second end of the second boom to move in the vertical direction relative to the base;

wherein the first actuator and the second actuator are operable independently of each other; and a controller, wherein the controller is operable to independently control the first actuator and the second actuator;

whereby the first end and the second end of the upper frame are selectively moveable in the vertical direction to elevate the exercise machine with respect to the base and to provide the exercise machine with an angle of inclination between a first end and a second end of the exercise machine relative to a horizontal plane;

wherein the first pivotable connection is closer to the second end of the base than the first end of the base, and wherein the second pivotable connection is closer to the first end of the base than the second end of the base.

11. The exercise machine of claim 10, wherein:

the first boom comprises a first pair of parallel booms each having a first end pivotably connected to the base and a second distal end connected to the upper frame at or near the first end of the upper frame;

the second boom comprises a second pair of parallel booms each having a first end pivotably connected to the base and a second distal end connected to the upper frame at or near the second end of the upper frame;

wherein the first pair and second pair of parallel booms are connected to the base opposing each other.

12. The exercise machine of claim 11, including:

a first yoke extending transversely between and connecting the first pair of parallel booms near respective second ends of the first pair of parallel booms, the first actuator pivotably connected to the first yoke, the first yoke thereby pivotably connecting the first actuator to the first pair of parallel booms; and a second yoke extending transversely between and connecting the second pair of parallel booms near their second ends of the second pair of parallel booms, the second actuator pivotably connected to the second yoke, the second yoke thereby pivotably connecting the second actuator to the second pair of parallel booms.

13. The exercise machine of claim 10, wherein the first actuator and the second actuator are luffing actuators.

14. The exercise machine of claim 10, wherein the first actuator and the second actuator are comprised of a linear actuator, a non-linear actuator, a hydraulic actuator, a pneumatic actuator, an electric actuator, or a mechanical actuator.

15. The exercise machine of claim 10, including:

a first lifting member connected to the upper frame near the first end and extending transversely to a longitudinal axis of the upper frame;

a second lifting member connected to the upper frame near the second end and extending transversely to the longitudinal axis of the upper frame; and wherein the first boom and the second boom each has a cradle near a respective second end, the cradle of the first boom in contact with and supporting the first lifting member, and the cradle of the second boom in contact with and supporting the second lifting member.

16. The exercise machine of claim 10, further comprising a biasing member connected to the movable platform to provide a resistance force to the movable platform.

17. An exercise machine, comprising:

an upper frame having at least one track, a first end and a second end opposite the first end;

a movable platform moveably connected to the at least one track and adapted to be moveable along at least a portion of the at least one track;

at least one spring connected to the movable platform, wherein the at least one spring provides a resistance force to the movable platform;

a base, wherein the base includes a first end and a second end, wherein the first end of the base is closer to the first end of the upper frame than the second end of the base;

a first boom having a first end pivotably connected to the base and a second end connected to the upper frame at or near the first end of the upper frame;

a second boom having a first end pivotably connected to the base and a second end connected to the upper frame;

wherein the second end of the first boom is closer to the first end of the upper frame than the second end of the second boom;

wherein the first boom extends in a first direction that extends upwardly and towards the first end of the upper frame;

wherein the second boom extends in a second direction that extends upwardly and towards the second end of the upper frame;

a first actuator having a first end connected to the base and a second end connected to the first boom;

a second actuator having a first end connected to the base and a second end connected to the second boom;

wherein the first boom is pivotably connected to the first actuator and the second boom is pivotably connected to the second actuator;

wherein the first actuator and the second actuator are comprised of linear actuators;

wherein the first actuator is operable to cause the first end of the first boom to rotate about a first pivotable connection to the base and thereby cause the second end of the first boom to move in a vertical direction relative to the base;

wherein the second actuator is operable to cause the first end of the second boom to rotate about a second pivotable connection to the base and thereby cause the second end of the second boom to move in the vertical direction relative to the base;

wherein the first actuator and the second actuator are operable independently of each other; and a controller, wherein the controller is operable to independently control the first actuator and the second actuator;

wherein the second end of the base is closer to the second end of the upper frame than the first end of the base;

whereby the first end and the second end of the upper frame are selectively moveable in the vertical direction to elevate the exercise machine with respect to the base and to provide the exercise machine with an angle of inclination between a first end and a second end of the exercise machine relative to a horizontal plane;

wherein the first pivotable connection is closer to the second end of the base than the first end of the base, and wherein the second pivotable connection is closer to the first end of the base than the second end of the base.

18. The exercise machine of claim 17, wherein the first actuator and the second actuator are comprised of a hydraulic actuator, a pneumatic actuator, an electric actuator, or a mechanical actuator.

* * * * *